US009272865B2

(12) United States Patent
Tsumura et al.

(10) Patent No.: US 9,272,865 B2
(45) Date of Patent: Mar. 1, 2016

(54) SHEET TRANSFER DEVICE

(71) Applicant: RISO KAGAKU CORPORATION, Tokyo (JP)

(72) Inventors: Akihiro Tsumura, Ibaraki (JP); Eijiro Arimura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/494,640

(22) Filed: Sep. 24, 2014

(65) Prior Publication Data

US 2015/0084266 A1 Mar. 26, 2015

(30) Foreign Application Priority Data

Sep. 26, 2013 (JP) ..... 2013-199310

(51) Int. Cl.
*B65H 5/06* (2006.01)
*B65H 5/38* (2006.01)

(52) U.S. Cl.
CPC ..... *B65H 5/38* (2013.01); *B65H 5/062* (2013.01); *B65H 2404/144* (2013.01); *B65H 2404/611* (2013.01); *B65H 2601/11* (2013.01)

(58) Field of Classification Search
CPC ..... B65H 5/062; B65H 2402/441; B65H 2404/14; B65H 2404/142; B65H 2404/1422; B65H 2404/144; B65H 2404/1441; B65H 2404/1442; B65H 2404/15; B65H 2404/1523; B65H 2601/11; B65H 2601/321
USPC ..... 271/273, 274
See application file for complete search history.

(56) References Cited

U.S. PATENT DOCUMENTS

| | | | | |
|---|---|---|---|---|
| 5,134,443 | A * | 7/1992 | Sumi et al. | 399/121 |
| 5,293,203 | A * | 3/1994 | Wada et al. | 399/124 |
| 6,145,828 | A * | 11/2000 | Arai | 271/3.03 |
| 8,083,230 | B2 * | 12/2011 | Spence | 271/273 |
| 2007/0024000 | A1 * | 2/2007 | Miyazaki et al. | 271/293 |
| 2009/0194939 | A1 * | 8/2009 | Matsushima | 271/278 |

FOREIGN PATENT DOCUMENTS

JP 2009031422 A 2/2009

* cited by examiner

*Primary Examiner* — Jeremy R Severson
(74) *Attorney, Agent, or Firm* — Greenblum & Bernstein, P.L.C.

(57) ABSTRACT

A first sheet transfer guide plate includes a first divided sheet guide plate and a second divided sheet guide plate separable from each other. The first divided sheet guide plate is capable of being drawn out or pushed in relative to the second sheet transfer guide plate in a sheet width direction. The first divided sheet guide plate and the second divided sheet guide plate are separable from each other by a draw-out operation or a push-in operation of the first divided sheet guide plate. The first divided sheet guide plate is configured to release nipping of a sheet by paired sheet transfer rollers corresponding to the first divided sheet guide plate, along with the draw-out operation or the push-in operation of the first divided sheet guide plate.

6 Claims, 10 Drawing Sheets

SHEET TRANSFER DEVICE

CROSS REFERENCE TO RELATED APPLICATION

This application is based upon and claims the benefit of priority from the prior Japanese Patent Application No. 2013-199310, filed on Sep. 26, 2013, the entire contents of which are incorporated herein by reference.

BACKGROUND

1. Technical Field

The disclosure relates to a sheet transfer device which allows a sheet, if jammed across the sheet transfer device and its adjacent sheet transfer device provided along a sheet transfer route in an image forming apparatus while being transferred along the sheet transfer route, to be easily taken out from the devices without leaving the jammed sheet in the devices.

2. Related Art

Generally, the sheet transfer device configured to transfer sheets is applied to an image forming apparatus such as a printing apparatus configured to print images and characters on sheets and a photocopier configured to duplicate images and characters on sheets.

Japanese Unexamined Patent Application Publication No. 2009-31422 proposes such an image forming apparatus to which the sheet transfer device is applied. When paper jam occurs and a jammed sheet exists across a main body and a drawer unit, the proposed image forming apparatus can automatically prevent the jammed sheet from being torn.

Although illustration is omitted herein, the image forming apparatus described in Japanese Unexamined Patent Application Publication No. 2009-31422 includes units for sheet transfer (for example, a sheet transfer unit and a duplex printing unit) as drawer units in various portions of the apparatus such that the units can be drawn out toward the front of the main body in a substantially horizontal direction.

For example, in the aforementioned sheet transfer unit, a base portion is attached to be capable of being drawn out in the horizontal direction by engaging with rails in the main body. Moreover, a sheet guide member is attached onto the base portion to be openable and closeable by turning about a supporting shaft extending in a sheet width direction orthogonal to the sheet transfer direction.

A sheet transfer route for transferring sheets is formed between the base portion and the sheet guide member and a pair of upper and lower sheet transfer rollers are provided along the sheet transfer route.

When sheet jam occurs, a controller stops all of the sheets being transferred in the main body. In addition, if the sheet is stopped to exist across the main body and the drawer unit configured as described above, the controller moves the stopped sheet such that the sheet can completely enter the drawer unit or the main body.

Moreover, Japanese Patent Application Publication No. 2009-31422 states a jammed sheet can be taken out from the sheet transfer route in such a way that: the sheet transfer unit is drawn out from the main body; and then the sheet transfer route is exposed with the sheet guide member opened upward from the base portion, for example.

SUMMARY

As mentioned above, Japanese Unexamined Patent Application Publication No. 2009-31422 states that, in the image forming apparatus described therein, the controller moves the sheet such that the sheet can completely enter the drawer unit or the main body when the sheet stops to exist across the drawer unit and the main body in occurrence of sheet jam. However, if the jammed sheet existing across the drawer unit and the main body is moved to completely enter the drawer unit or the main body, the jamming state of the sheet may become worse.

Moreover, in case of drawing out the drawer unit and taking out the jammed sheet, the drawer unit needs to be fully drawn out. Accordingly, the jammed sheet may be difficult to take out if the unit is heavy.

Furthermore, when the drawer unit is drawn out substantially horizontally toward the front of the apparatus to take out the jammed sheet, an area occupied by the drawn-out drawer unit is equal to an exterior size of the drawer unit. Hence, this occupied area is large.

An object of the present invention is to provide a sheet transfer device which allows a sheet, if jammed across the sheet transfer device and its adjacent sheet transfer device provided along a sheet transfer route in an image forming apparatus while being transferred along the sheet transfer route, to be easily taken out from the devices without leaving any piece of the jammed sheet in the device and which allows the sheet to be easily taken out while being designed such that a member provided in the sheet transfer device occupies only a small area when being drawn out to protrude from the device in the take out of the jammed sheet.

A sheet transfer device in accordance with some embodiments includes: a sheet transfer unit including a plurality of paired sheet transfer rollers arranged along a sheet transfer route, and configured to transfer a sheet in a sheet transfer direction while nipping the sheet between each of the plurality of paired sheet transfer rollers; and first and second sheet transfer guide plates arranged along the sheet transfer route to face each other and configured to guide the sheet transferred by the sheet transfer unit. The first sheet transfer guide plate includes a first divided sheet guide plate and a second divided sheet guide plate separable from each other. The first divided sheet guide plate is capable of being drawn out or pushed in relative to the second sheet transfer guide plate in a sheet width direction orthogonal to the sheet transfer direction. The first divided sheet guide plate and the second divided sheet guide plate are separable from each other by a draw-out operation or a push-in operation of the first divided sheet guide plate. The first divided sheet guide plate is configured to release nipping of the sheet by the paired sheet transfer rollers corresponding to the first divided sheet guide plate, along with the draw-out operation or the push-in operation of the first divided sheet guide plate.

According to the configuration described above, even if a jammed sheet placed on the second sheet transfer guide plate exists across the sheet transfer device and its adjacent sheet transfer device, the jammed sheet placed on the second sheet transfer guide plate is not torn in the draw-out operation or the push-in operation of the first divided sheet guide plate. Moreover, when the first divided sheet guide plate is drawn out or pushed in, the user can easily take out the jammed sheet from the device with his/her hand without leaving any piece of the jammed sheet in the device.

Furthermore, the first sheet transfer guide plate is divided into two parts of the first divided sheet guide plate and the second divided sheet guide plate. Accordingly, for example, when the first divided sheet guide plate is drawn out toward the front side of the device, an area occupied by the first divided sheet guide plate outside the device can be reduced compared to that in a conventional device. Meanwhile, when the first divided sheet guide plate is pushed in, for example, toward the rear side of the device, there is no member protruding toward the front side of the device. Accordingly, the front side of the device can be effectively used.

The first sheet transfer guide plate may be configured to release nipping of the sheet by the paired sheet transfer rollers corresponding to the second divided sheet guide plate, along with the draw-out operation or the push-in operation of the first divided sheet guide plate.

According to the configuration described above, the jammed sheet released from nipping on both of the first and second divided sheet guide plate sides can be more easily taken out.

A separation position of the first divided sheet guide plate and the second divided sheet guide plate may be located between an end portion of a smallest sheet in a draw-out direction of the first divided sheet guide plate and a center line of the smallest sheet in a width direction of the smallest sheet or located on the center line of the smallest sheet in the width direction, the smallest sheet being a sheet of a smallest size among sheets of different sizes to be transferred along the sheet transfer route.

According to the configuration described above, sheets of various sizes can be surely taken out.

DETAILED DESCRIPTION

DETAILED DESCRIPTION

Figure 1:
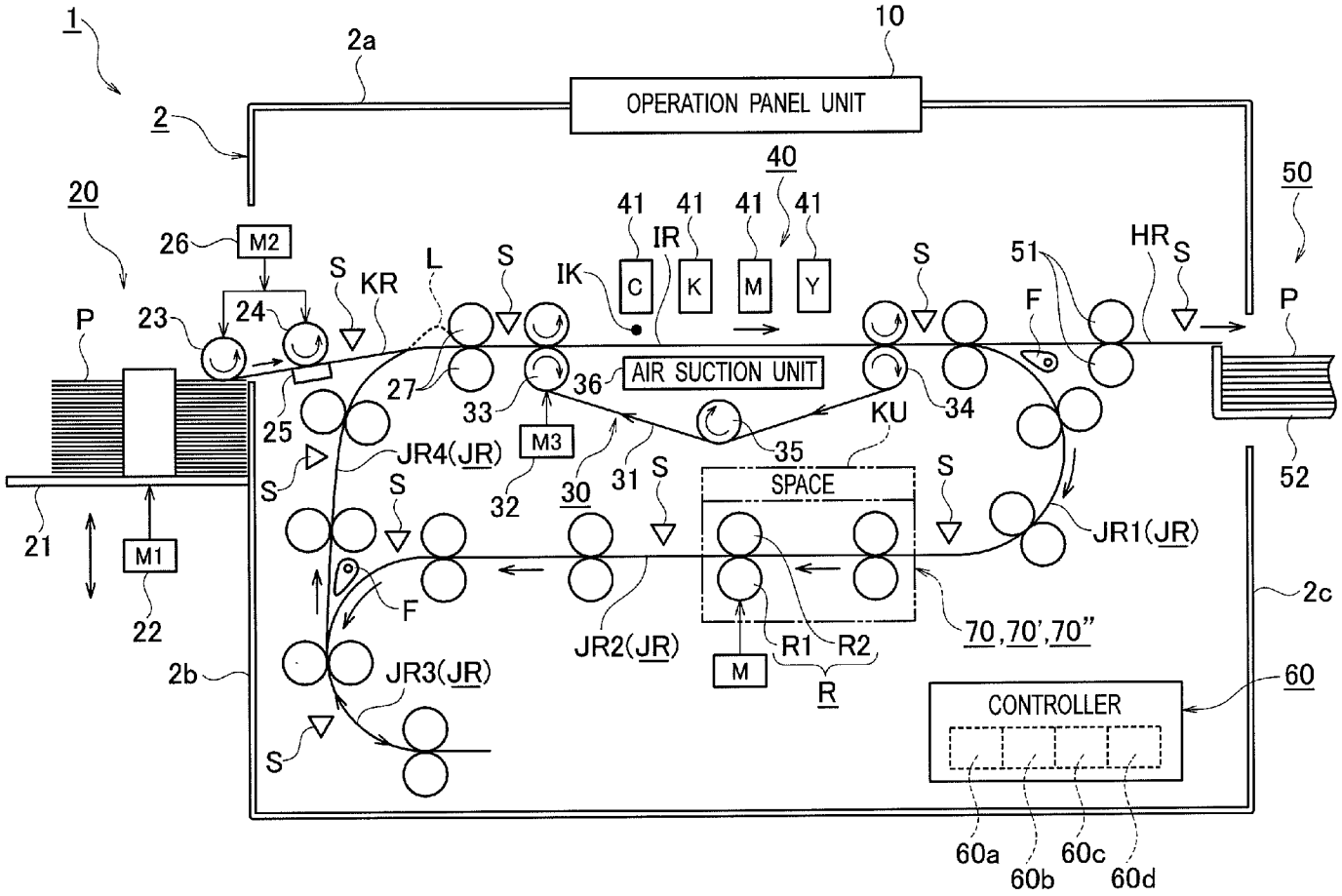
FIG. 1 is a configuration diagram showing an overall configuration of an inkjet printer to which sheet transfer devices in embodiments of the present invention are applied.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Sheet transfer devices in embodiments of the present invention are described below in detail for each of modes to be carried out with reference to FIGS. 1 to 10C, in the order of Embodiment 1 and Embodiment 2. In the drawings, a transfer direction of a sheet P, a width direction of the sheet P, a draw-out direction of a first divided sheet guide plate 82 are denoted by TD, WD, and DD, respectively. Moreover, in the drawings, an upstream side, a downstream side, a front side, and a rear side are denoted by US, DS, FT, and RR, respectively.

The sheet transfer devices in the embodiments of the present invention are applied to an image forming apparatus such as a printing apparatus configured to print images and characters on sheets and a photocopier configured to duplicate images and characters on sheets. The sheet transfer device is unitized and provided along a sheet transfer route for transferring the sheet in the image forming apparatus.

Each of the aforementioned sheet transfer devices is configured such that, when sheet jam occurs across the sheet transfer device and its adjacent sheet transfer device provided along the sheet transfer route while a sheet is transferred along the sheet transfer route in the image forming apparatus, a jammed sheet can be easily taken out from the devices without leaving any piece of the jammed sheet in the devices.

Before giving description of the sheet transfer devices in Embodiments 1 and 2 of the present invention, by using FIG. 1, an inkjet printer is described as an example of the image forming apparatus to which the sheet transfer devices in Embodiments 1 and 2 are applied.

FIG. 1 shows an inkjet printer 1 to which a sheet transfer device 70 of Embodiment 1, a sheet transfer device 70' in a modified example partially-modified from Embodiment 1, or a sheet transfer device 70" of Embodiment 2 is applied.

As shown in FIG. 1, the inkjet printer 1 is capable of performing simplex printing or duplex printing on the sheets P by an inkjet method and includes: an operation panel unit 10 used to operate the entire apparatus; a paper feeder 20 configured to feed the sheets P one by one; a belt platen unit 30 rotatably provided downstream of the paper feeder 20 in a sheet transfer direction; a printing unit 40 provided with multiple line inkjet heads 41 which face the belt platen unit 30 and which eject multiple color inks IK; a paper discharge unit 50 configured to discharge the printed sheets P subjected to printing in the printing unit 40; and a controller 60 configured to control the entire apparatus.

Moreover, the sheet transfer route through which the sheets P are transferred at a constant speed in the inkjet printer 1 includes: a paper feed transfer route KR which extends from the paper feeder 20 to the belt platen unit 30 and the printing unit 40; a print transfer route IR which extends along the belt platen unit 30 and the printing unit 40; a discharge transfer route HR which extends from the belt platen unit 30 and the printing unit 40 to the paper discharge unit 50; and a circulation transfer route JR which is provided between the paper feeder 20 and the paper discharge unit 50 and which allows the sheet P printed on one side to be transferred along and below the belt platen unit 30 and then circulated to the print transfer route IR in such a way that duplex printing can be performed on the sheet P.

In the aforementioned circulation transfer route JR, a first vertical transfer route JR1, a horizontal transfer route JR2, a switchback transfer route JR3, and a second vertical transfer route JR4 are continuously connected to one another in this order. The first vertical transfer route JR1 allows the sheet P printed on one side to be transferred to a portion below the belt platen unit 30, the horizontal transfer route JR2 allows the sheet P printed on one side to be transferred substantially horizontally from the portion below the belt platen unit 30 toward an upstream side in the sheet transfer direction, the switchback transfer route JR3 allows the sheet P printed on one side to be transferred such that the sheet P is switched back and a leading end of the sheet P is changed from a front end portion to a rear end portion, and the second vertical transfer route JR4 allows the sheet P switched back and printed on one side to be transferred upward again to the belt platen unit 30 and the printing unit 40 with the sheet P being turned over.

The sheet transfer device 70 of Embodiment 1, the sheet transfer device 70' of the modified example partially-modified from Embodiment 1, or the sheet transfer device 70" of Embodiment 2 is unitized and provided along, for example, the horizontal transfer route JR2. The sheet transfer devices 70, 70', 70" will be described in detail later.

Multiple sheet transfer roller pairs R configured to transfer the sheets P at the constant speed are provided in the sheet transfer route at such intervals that the sheet transfer roller pairs R can transfer a sheet of the smallest size out of multiple types of the sheets P different in size. In this configuration, each of the sheet transfer roller pairs R is formed of a pair of a drive roller R1 connected to and rotated by a geared motor M which is a drive source and a driven roller R2 driven by coming into pressure contact with the drive roller R1.

Moreover, multiple sheet sensors S configured to detect passage of each sheet P are provided in the sheet transfer route at appropriate positions. The multiple sheet sensors S can detect occurrence of sheet jam via the controller 60 by using light reflective sensors or light transmission sensors, when the sheet P transferred at the constant speed does not reach a position of each sensor at a preset time.

Furthermore, flippers F for switching a transfer direction of the sheets P are turnably provided between the discharge transfer route HR and the first vertical transfer route JR1 in the circulation transfer route JR and between the switchback transfer route JR3 in the circulation transfer route JR and the second vertical transfer route JR4.

Units of the inkjet printer 1 are specifically described one by one. A case 2 forming an exterior of the inkjet printer 1 is formed in a box shape.

Firstly, the operation panel unit 10 described above is provided on a top surface 2*a* of the case 2. Although detailed illustration is omitted herein, the operation panel unit 10 is provided with a simplex/duplex printing selection key, a start key, a stop key, numeric keys, a copy number setting key, an alarm display, a liquid crystal display panel, and the like.

Next, the aforementioned paper feeder 20 is provided with a paper feed tray 21 which can be moved upward and downward along an outer side of a left plate 2*b* of the case 2 by a first geared motor 22.

Moreover, one type of sheet P out of multiple types of sheets P ranging from the sheet P of the smallest size (for example, postcard size) to the sheet P of the largest size (for example, A3 size) is stacked on the paper feed tray 21, and the sheet size of the one type of sheet P is automatically detected in the paper feed tray 21 by a not-illustrated sheet size detector.

When the paper feed tray 21 moves upward and the sheet P in the top layer among the unprinted sheets P stacked on the paper feed tray 21 reaches a paper feed position, a paper feed roller 23 comes into pressure contact with the sheet P in the top layer while rotating and feeds this sheet P.

Thereafter, the thus-fed sheets P are separated from each other into single sheets when being transferred and held between a separation roller 24 and a friction pad 25 which are provided downstream of the paper feed roller 23.

The paper feed roller 23 and the separation roller 24 are driven by a second geared motor 26, which is a common drive source, to rotate clockwise.

Furthermore, a front end of each fed sheet P in the transfer direction abuts on a registration roller pair 27 which is not rotating and a loop L illustrated by a dotted line is formed. Due to this loop L, a front end position of the sheet P is aligned with the registration roller pair 27.

Thereafter, the registration roller pair 27 starts to rotate and thereby transfers the sheet P to the belt platen unit 30 and the printing unit 40 with skewing of the sheet P corrected and with a transfer timing of the sheet P adjusted.

The paper feed roller 23, the separation roller 24, and the friction pad 25 form a first paper feeder which feeds the sheets P stacked on the paper feed tray 21 one by one. Meanwhile, the registration roller pair 27 forms a second paper feeder which transfers the sheets P fed by the first paper feeder downstream with the skewing of the sheet P corrected and with the transfer timing of the sheet P adjusted.

Next, in the aforementioned belt platen unit 30, a belt platen 31 having multiple air suction holes (not illustrated) and formed in a belt shape is endlessly wound around a drive pulley 33 and a driven pulley 34 with an intermediate pulley 35 provided therebetween, the drive pulley 33 being driven by a third geared motor 32 to rotate at a constant transfer speed. Each sheet P transferred onto the belt platen 31 is transferred in the direction of the arrow by the belt platen 31 while being suctioned by an air suction unit 36.

The aforementioned printing unit 40 is provided above the belt platen unit 30 to face the belt platen unit 30 with a small gap provided therebetween, and is disposed in a substantially-center portion of the case 2.

In the printing unit 40, the multiple line inkjet heads 41 corresponding to inks IK of multiple colors are fixedly provided such that a C (cyan) inkjet head, a K (black) inkjet head, a M (magenta) inkjet head, and a Y (yellow) inkjet head are arranged in this order from the upstream side to the downstream side in the transfer direction of the sheets P.

Here, illustrated is an example in which the four line inkjet heads 41 corresponding to the inks IK of four colors (CKMY) are provided to perform color printing on the sheets P. However, for example, since only an inkjet head for one color (K) is necessary in a case of printing just characters, it is only necessary to install at least one line inkjet head 41.

The multiple line inkjet heads 41 print a color image on each sheet P while the sheet P is transferred in the direction of the arrow by the rotation of the belt platen 31 with sheet P fixed onto the belt platen 31 by air suction.

In this case, when the color image is printed on one surface of the sheet P, the sheet P is made to pass through the print transfer route IR once and is then discharged to the paper discharge unit 50 to be described later. Meanwhile, when the color image is printed on both surfaces of the sheet P, the sheet P printed on one surface is made to path through the print transfer route IR for the second time via the circulation transfer route JR and is then discharged to the paper discharge unit 50 to be described later.

The aforementioned paper discharge unit 50 is provided downstream of the belt platen unit 30 and the printing unit 40, on a right plate 2*c* side of the case 2. In the paper discharge unit 50, the sheets P printed on one side or printed on both sides are discharged onto a paper receiving tray 52 via a discharge roller pair 51.

Next, the controller 60 configured to control the entire apparatus is provided at an appropriate position in the case 2. The controller 60 includes therein: a CPU 60*a* configured to perform calculation processing and determination processing; a ROM 60*b* configured to store an operation program of the inkjet printer 1 and the like; a RAM 60*c* configured to temporarily store various types of information which can be changed in the inkjet printer 1; and a timer 60*d* configured to measure the time at which the sheet P passes each sheet sensor S.

Embodiment 1

A configuration of a sheet transfer device in Embodiment 1 of the present invention is described by using aforementioned FIG. 1 and newly-presented FIGS. 2 to 5B.

Figure 2:
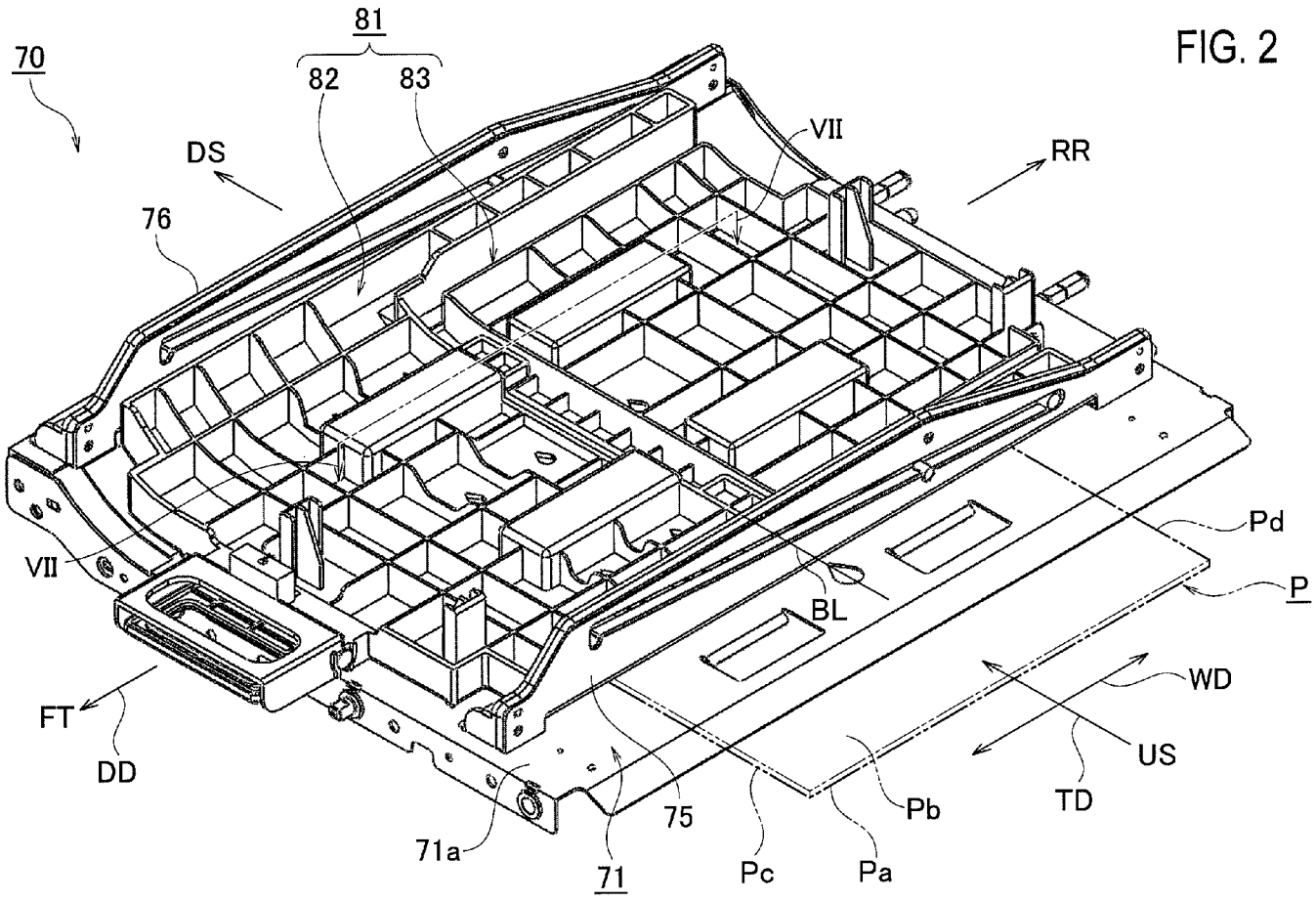
FIG. 2 is a perspective view showing a sheet transfer device in Embodiment 1 of the present invention.
Figure 3:
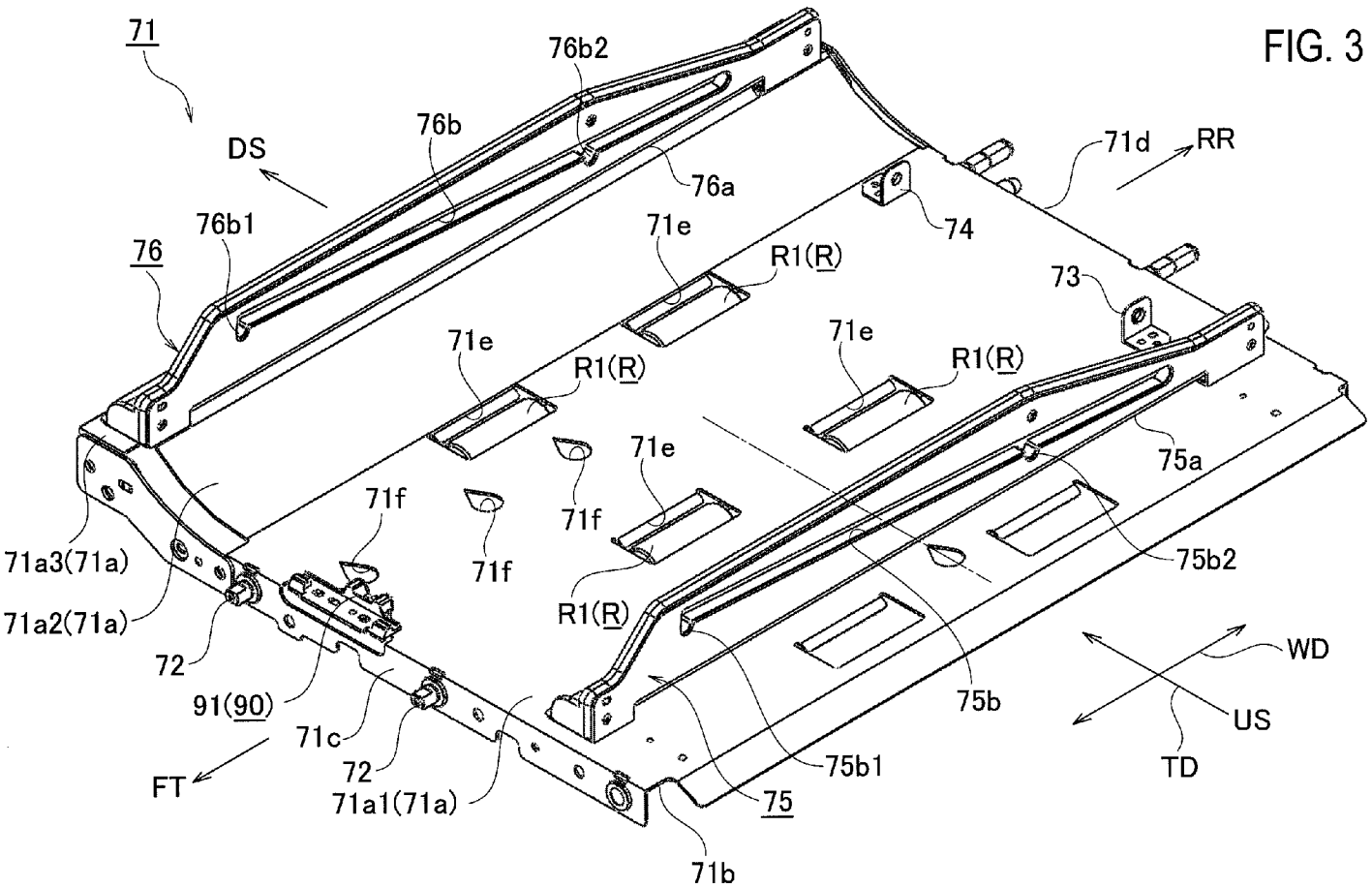
FIG. 3 is a perspective view showing a drive-roller-side sheet transfer guide plate shown in FIG. 2.
Figure 4:
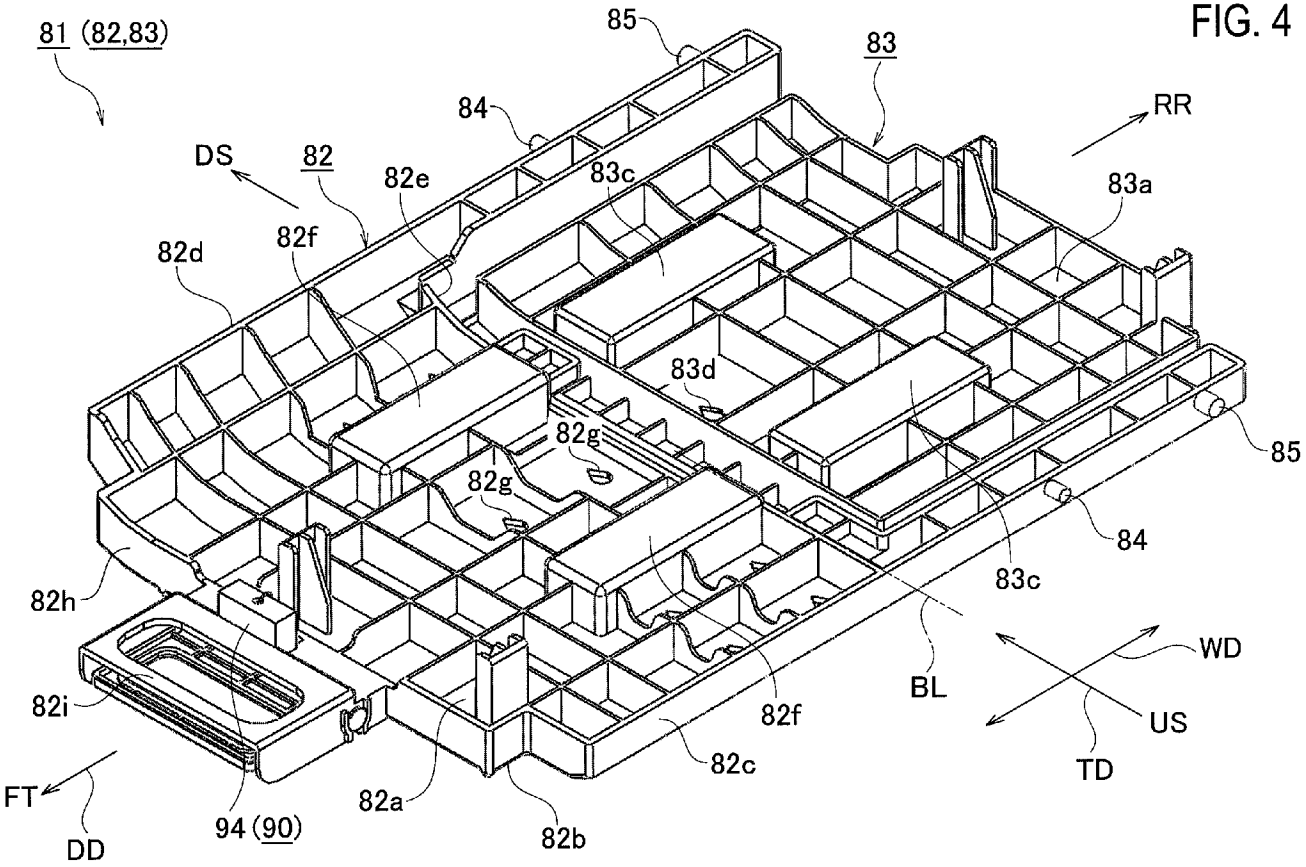
FIG. 4 is a perspective view showing a driven-roller-side sheet transfer guide plate shown in FIG. 2.
Figure 5A:
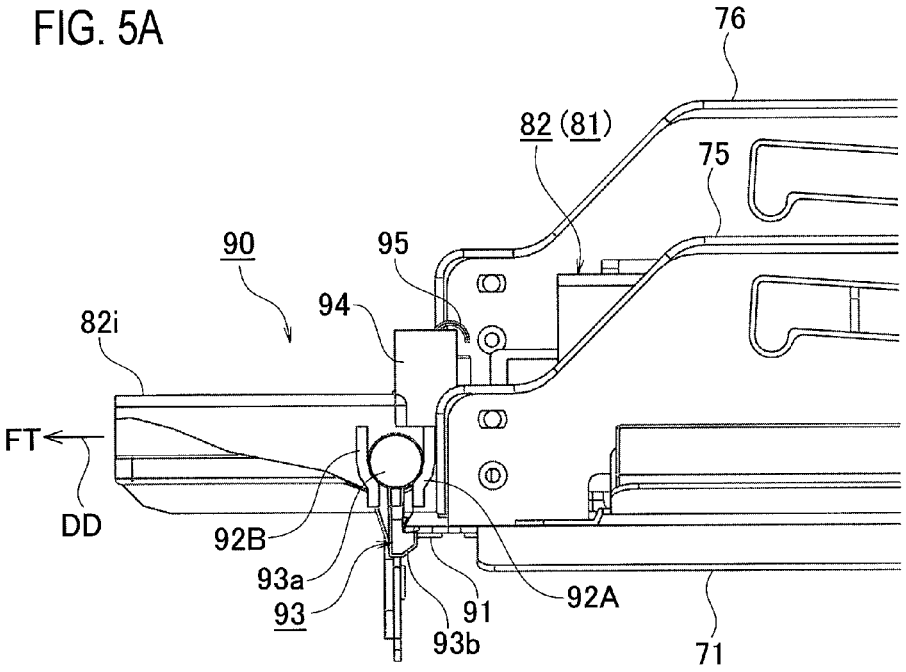
FIG. 5A is a side view showing a lock mechanism shown in FIGS. 3 and 4 in a locked state.
Figure 5B:
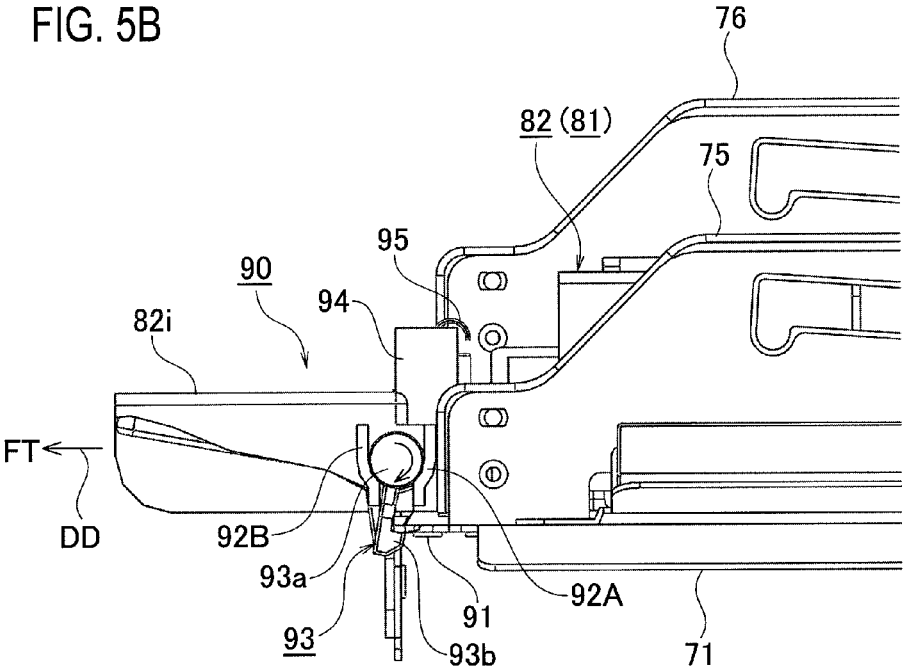
FIG. 5B is a side view showing the lock mechanism shown in FIGS. 3 and 4 in an unlocked state.

FIG. 2 shows a perspective view of the sheet transfer device 70 of Embodiment 1 of the present invention. FIG. 3 shows a perspective view of a drive-roller-side sheet transfer guide plate 71 shown in FIG. 2. FIG. 4 shows a perspective view of a driven-roller-side sheet transfer guide plate 81 (82, 83) shown in FIG. 2. FIGS. 5A and 5B show a lock mechanism 90 shown in FIGS. 3 and 4.

As shown in FIG. 1, the sheet transfer device 70 of Embodiment 1 of the present invention is provided along the sheet transfer route in the inkjet printer 1. For example, the sheet transfer device 70 is unitized and provided along the horizontal transfer route JR2 in the circulation transfer route JR forming part of the sheet transfer route.

As described above, the horizontal transfer route JR2 in the circulation transfer route JR are provided with the multiple sheet transfer roller pairs R each formed of a pair of the drive roller R1 and the driven roller R2, the drive roller R1 being connected to the geared motor M which is a drive source and being driven and rotated by the geared motor M, the driven roller R2 being driven by coming into pressure contact with the drive roller R1. The drive rollers R1 and the driven roller R2 of the sheet transfer roller pairs R form a sheet transfer unit configured to transfer the sheet P while nipping the sheet P between the rollers R1 and R2.

Installing the sheet transfer device 70 of Embodiment 1 along the horizontal transfer route JR2 in the circulation transfer route JR allows a jammed sheet (not illustrated) to be easily taken out from the device 70 when sheet jam occurs across, for example, the first vertical transfer route JR1 and the horizontal transfer route JR2 in the circulation transfer route JR, without leaving any piece of the jammed sheet in the transfer routes JR1 and JR2.

In this case, since the belt platen unit 30 is provided above the sheet transfer device 70 of Embodiment 1 and a space KU large enough for a person to insert his/her hand is formed in a front side (front surface side) portion of the device 70 between the belt platen unit 30 and the sheet transfer device 70, the jammed sheet can be recovered by inserting the person's hand into the space KU as will be described later.

Here, description is given by using both of FIGS. 1 and 2. In the sheet transfer device 70 of Embodiment 1, the drive-roller-side sheet transfer guide plate (hereafter, simply referred to as drive-side sheet guide plate) 71 is fixedly provided on the drive roller R1 side of the sheet transfer roller pairs R along the horizontal transfer route JR2 in the circulation transfer route JR. The drive-side sheet guide plate 71 guides one surface (bottom surface) Pa of the sheet P transferred in the sheet transfer direction by the multiple sheet transfer roller pairs R.

Meanwhile, the driven-roller-side sheet transfer guide plate (hereafter, simply referred to as driven-side sheet guide plate) 81 faces a top surface 71*a* of the drive-side sheet guide plate 71 with a small gap provided therebetween, and is provided on the driven roller R2 side of the sheet transfer roller pairs R along the horizontal transfer route JR2 in the circulation transfer route JR. Moreover, the driven-side sheet guide plate 81 guides the other surface (top surface) Pb of the sheet P transferred in the sheet transfer direction by the multiple sheet transfer roller pairs R.

Here, the driven-side sheet guide plate 81 is divided into two parts of: a first divided sheet guide plate 82 provided to be capable of being drawn out toward the front side (front surface side) which is one surface side of the device 70; and a second divided sheet guide plate 83 provided to stay on a rear side (rear surface side), which is another surface side of the device 70 opposite to the one surface side.

Note that the front side (front surface side) of the device 70 is set to be one side of a sheet width direction orthogonal to the transfer direction of the sheet P, and the rear side of (rear surface side) of the device 70 is set to be the other side of the sheet width direction orthogonal to the transfer direction of the sheet P.

A dividing line BL between the first and second divided sheet guide plates 82 and 83 extends substantially along the transfer direction of the sheet P and is set near a center line in the sheet width direction orthogonal to the sheet transfer direction.

In this case, the sheets P of various sizes can be surely taken out by setting the dividing position of the driven-side sheet guide plate 81 between an end portion Pc of the sheet P on the front side of the device 70 and the center line of the sheet P in the width direction thereof or on the center line of the sheet P in the width direction thereof, the sheet P being a sheet of the smallest size among the sheets of different sizes which are transferred along the sheet transfer route.

In other words, the first divided sheet guide plate 82 forting part of the driven-side sheet guide plate 81 is provided on the one side of the sheet width direction orthogonal to the sheet transfer direction to be capable of being drawn out in the width direction of the sheet P corresponding to the left end portion Pc side of the sheet P in the width direction.

In this case, the first divided sheet guide plate 82 is attached to be capable of being drawn out in the draw-out direction toward the front side (front surface side) of the device 70 while being guided by paired draw-out guide plates 75 and 76 provided respectively in an upstream portion and a downstream portion of the drive-side sheet guide plate 71 in the sheet transfer direction.

Meanwhile, the second divided sheet guide plate 83 forming part of the driven-side sheet guide plate 81 is provided to stay on the other side of the sheet width direction, which is opposite to the one side corresponding to a right end portion Pd side of the sheet P in the width direction. Moreover, the second divided sheet guide plate 83 is turnably supported in a rear side (rear surface side) portion of the device 70.

Here, as shown in FIG. 3, the drive-side sheet guide plate 71 described above is formed by using a metal plate material and has the top surface 71*a* including: a first flat surface 71*a*1 formed to have a long length in the sheet transfer direction; a recess-shaped curved surface 71*a*2 continuously connected to a downstream portion of the first flat surface 71*a*1 and curved in a recess shape extending upward by a small amount; and a second flat surface 71*a*3 formed downstream of the recess-shaped curved surface 71*a*2 at a height level slightly higher than the first flat surface 71*a*1 to have a short length in the sheet transfer direction, the surfaces 71*a*1, 71*a*2, and 71*a*3 being arranged in this order from the upstream side to the downstream side in the transfer direction of the sheets P. Moreover, front and rear side surfaces 71*c* and 71*d* corresponding respectively to the front and rear sides are formed by being bent downward.

In Embodiment 1, the downstream portion of the top surface 71*a* of the drive-side sheet guide plate 71 is curved in the recess shape extending upward by a small amount by providing the recess-shaped curved surface 71*a*2, due to reasons such as arrangement relationships of peripheral parts. However, it is more preferable that the entire top surface 71*a* is formed to be a flat surface.

The drive-side sheet guide plate 71 is formed in a substantially-rectangular shape with the dimension thereof in the sheet transfer direction being set to an appropriate value according to the unitization and with the dimension thereof in the sheet width direction being set to a value larger than a width dimension of the sheet of the largest size (for example, A3 size).

Moreover, multiple rectangular holes 71*e* are formed on front left, front right, rear left, and rear right sides of an intermediate portion of the first flat surface 71*a*1 of the drive-side sheet guide plate 71 to penetrate the drive-side sheet guide plate 71. The drive rollers R1 of the sheet transfer roller pairs R are exposed from the multiple rectangular holes 71*e* to slightly protrude from the bottom surface 71*b* side to the top surface 71*a* side.

The drive rollers R1 are fixedly attached to two long first roller shafts 72 which are rotatably supported between the front and rear side surfaces 71*c* and 71*d* of the drive-side sheet guide plate 71 and which are provided at a predetermined interval in the sheet transfer direction while extending in the sheet width direction. The drive rollers R1 are fixedly attached to the first roller shafts 72 in a manner symmetric in the sheet width direction with respect to an imaginary transfer center line in transfer of the sheet P.

Note that the various types of sheets P different in sheet size are transferred on the drive-side sheet guide plate 71 while being nipped by the drive rollers R1 and the driven rollers R2 (FIG. 1) with the centers thereof being aligned with the imaginary transfer center line in transfer of the sheets P and without the positions of the left and right side end portions Pc and Pd (FIG. 2) being restricted.

Moreover, multiple finger holes 71*f* are formed in a front portion of the first flat surface 71*a*1 of the drive-side sheet guide plate 71 at positions corresponding respectively to the left end portions Pc (FIG. 2) of the various types of sheets P different in sheet size to penetrate the drive-side sheet guide plate 71. As will be described later, these multiple finger holes 71*f* function as escape holes used when a user holds a draw-out-side end portion of a jammed sheet (not illustrated) placed on the drive-side sheet guide plate 71 with his/her fingers.

Moreover, paired L-shaped brackets 73 and 74 are symmetrically attached to the first flat surface 71*a*1 of the drive-side sheet guide plate 71 separately at positions on the upstream side and the downstream side near the rear side surface 71*d* in such a way as not to affect the transfer of the sheet P. The paired L-shaped brackets 73 and 74 have a function of rotatably supporting a rear end of the second divided sheet guide plate 83 located in a rear portion of the driven-side sheet guide plate 81 (FIGS. 2 and 4).

The paired draw-out guide plates 75 and 76 are symmetrically attached to the first and second flat surfaces 71*a*1 and 71*a*3 to extend in the sheet width direction and to face each other while being provided respectively on the upstream side and the downstream side at an interval in the sheet transfer direction, the first and second flat surfaces 71*a*1 and 71*a*3 formed at different height levels in the upstream portion and the downstream portion of the top surface 71*a* of the drive-side sheet guide plate 71.

The paired draw-out guide plates 75 and 76 have a function of causing only the first divided sheet guide plate 82 of the driven-side sheet guide plate 81 (FIGS. 2 and 4) to be drawn out toward the front side.

In lower portions of the aforementioned paired draw-out guide plates 75 and 76 which face the top surface 71*a* of the drive-side sheet guide plate 71, sheet passage ports 75*a* and 76*a* through which the sheet P (FIGS. 1 and 2) passes are formed in a recess shape to extend in the sheet width direction. Moreover, in the paired draw-out guide plates 75 and 76, paired inclined guide grooves 75*b* and 76*b* are formed in an inclined manner to guide the first divided sheet guide plate 82 in such a way that the first divided sheet guide plate 82 can be gradually drawn out obliquely upward from the rear side toward the front side.

Small-diameter pins 84 (FIG. 4) and large-diameter pins 85 (FIG. 4) attached to upstream and downstream side surfaces 82*c* and 82*d* (FIG. 4) of the first divided sheet guide plate 82 (FIGS. 2 and 4) to be described later are fitted into the paired inclined guide grooves 75*b* and 76*b* described above.

Moreover, first positioning recesses 75*b*1 and 76*b*1 are formed continuously with front side ends of the inclined guide grooves 75*b* and 76*b* of the paired draw-out guide plates 75 and 76 in a shape recessed downward. Meanwhile, second positioning recesses 75*b*2 and 76*b*2 are formed continuously with rear portions of the inclined guide grooves 75*b* and 76*b* in a shape recessed downward.

In this case, causing the small-diameter pins 84 on the front side in the draw-out direction to fall into the first positioning recesses 75*b*1 and 76*b*1 positions the first divided sheet guide plate 82 at a maximum draw-out position, the small-diameter pins 84 being attached to the side surfaces 82*c* and 82*d* of the first divided sheet guide plate 82 (FIG. 4). Meanwhile, causing the small-diameter pins 84 on the front side in the draw-out direction to fall into the second positioning recesses 75*b*2 and 76*b*2 positions the first divided sheet guide plate 82 at a housed position.

Furthermore, a locked member 91 of the lock mechanism 90 is fixedly attached to a portion of the top surface 71*a* of the drive-side sheet guide plate 71 which is substantially at the center in the sheet transfer direction and which is on the front side surface 71*c* side. The lock mechanism 90 is used to lock the drive-side sheet guide plate 71 when the first divided sheet guide plate 82 (FIGS. 2 and 4) is housed in the device 70, and description thereof will be given later.

Next, as shown in FIG. 4, the first and second divided sheet guide plates 82 and 83 forming the driven-side sheet guide plate 81 are formed such that insides thereof on the top surfaces 82*a* and 83*a* side are provided with frameworks formed of multiple reinforcement ribs made of a resin material or a die-cast material and are thus formed to be stiff frame bodies.

Moreover, the bottom surfaces 82*b* (and 83*b*, not illustrated) of the first and second divided sheet guide plates 82 and 83 face the top surface 71*a* of the drive-side sheet guide plate 71 (FIG. 3) and are formed to be flat surfaces extending along the shape of the top surface 71*a* from the upstream side to the downstream side in the sheet transfer direction. Moreover, portions of the bottom surfaces 82*b* and 83*b* near downstream ends are curved upward.

Here, in the first divided sheet guide plate 82 capable of being drawn out toward the front side of the sheet transfer device 70, the side surfaces 82*c* and 82*d* on the upstream side and the downstream side extend toward the rear side beyond the dividing line BL and are thus formed to have long dimensions in the sheet width direction.

Moreover, the small-diameter pins 84 on the front side in the draw-out direction and the large-diameter pins 85 on the rear side in the draw-out direction are fixedly attached to the rear portions of the side surfaces 82*c* and 82*d* of the first divided sheet guide plate 82 to extend outward.

Furthermore, the two small-diameter pins 84 and the two large-diameter pins 85 fixedly attached to the side surfaces 82*c* and 82*d* of the first divided sheet guide plate 82 are fitted into the paired inclined guide grooves 75*b* and 76*b* slidably for drawing out, the inclined guide grooves 75*b* and 76*b* being formed in the paired draw-out guide plates 75 and 76 attached onto the drive-side sheet guide plate 71 described above by using FIG. 3.

Moreover, a rectangular recess 82*e* is formed inside the side surfaces 82*c* and 82*d* of the first divided sheet guide plate 82, on the rear side of the dividing line BL, to have a large area. The second divided sheet guide plate 83 on the rear side is located in the rectangular recess 82*e* when the first divided sheet guide plate 82 is housed in the device 70.

On the top surface 82*a* of the first divided sheet guide plate 82, two box portions 82*f* are formed near the dividing line BL separately on the upstream side and the downstream side to protrude with upper portions thereof being closed by lids. The driven rollers R2 (FIG. 1) are housed in the box portions 82*f* to face the drive rollers R1 (FIGS. 1 and 3).

Note that description is given later of a mechanism which causes the driven rollers R2 housed in the box portions 82*f* to come into pressure contact with the drive rollers R1 with the sheet P interposed therebetween.

Moreover, inspection holes 82*g* for checking whether the jammed sheet (not illustrated) is placed on the drive-side sheet guide plate 71 (FIGS. 2 and 3) are formed in the top surface 82*a* of the first divided sheet guide plate 82 between the two box portions 82*f* to penetrate the first divided sheet guide plate 82.

Furthermore, a handle 82*i* is formed in a substantially-center portion of a front side surface 82*h* of the first divided sheet guide plate 82 in the sheet transfer direction to protrude toward the front side. The user can draw out the first divided sheet guide plate 82 toward the front side by pulling the handle 82*i* toward the front side.

In addition, an unlock lever 94 of the lock mechanism 90 is attached to a rear portion of the handle 82*i* provided on the front side surface 82*h* of the first divided sheet guide plate 82 to correspond to the aforementioned locked member 91 of the lock mechanism 90 provided in the drive-side sheet guide plate 71 (FIG. 3). Description of the lock mechanism 90 will be given later.

Next, the second divided sheet guide plate 83 provided in the rear portion of the sheet transfer device 70 is housed in the rectangular recess 82*e* of the first divided sheet guide plate 82 as described above and is thus smaller than the first divided sheet guide plate 82. Also on the top surface 83*a* of this second divided sheet guide plate 83, two box portions 83*c* are formed near the dividing line BL separately on the upstream side and the downstream side to protrude with upper portions thereof being closed by lids. The driven rollers R2 (FIG. 1) are housed in the box portions 83*c* to face the drive rollers R1 (FIGS. 1 and 3).

Moreover, an inspection hole 83*d* for checking whether the jammed sheet (not illustrated) exist on the drive-side sheet guide plate 71 (FIGS. 2 and 3) is also formed in the top surface 83*a* of the second divided sheet guide plate 83 between the two box portions 83*c* to penetrate the second divided sheet guide plate 83.

Here, description is given of the lock mechanism 90 by using FIGS. 5A and 5B, the lock mechanism 90 configured to lock the first divided sheet guide plate 82 to the drive-side sheet guide plate 71 when the first divided sheet guide plate 82 is housed in the device 70. However, the lock mechanism 90 may have any structural form capable of locking the first divided sheet guide plate 82 to the drive-side sheet guide plate 71.

Specifically, as shown in FIGS. 5A and 5B, the first divided sheet guide plate 82 of the driven-side sheet guide plate 81 can be drawn out toward the front side between the paired draw-out guide plates 75 and 76 attached at the different height levels to the upstream portion and the downstream portion of the drive-side sheet guide plate 71 fixed inside the device 70.

Moreover, the lock mechanism 90 is attached to the drive-side sheet guide plate 71 and the first divided sheet guide plate 82 as described above.

Furthermore, the locked member 91 is attached onto the drive-side sheet guide plate 71.

Moreover, paired shaft supporting leaf spring members 92A and 92B are attached to a rear inner portion of the handle 82*i* of the first divided sheet guide plate 82 to face each other. A shaft 93*a* of a hook member 93 is turnably supported between the paired shaft supporting leaf spring members 92A and 92B to extend in a direction orthogonal to the draw-out direction, and the locked member 91 on the drive-side sheet guide plate 71 is locked by a hook portion 93*b* on the opposite side to the shaft 93*a*.

Moreover, the unlock lever 94 is connected to an upper end of the shaft supporting leaf spring member 92A out of the paired shaft supporting leaf spring members 92A and 92B and protrudes upward from a rear portion of the handle 82*i*.

Furthermore, a tension spring 95 is housed inside the unlock lever 94, and is hooked to the unlock lever 94 and the shaft supporting leaf spring member 92A. As shown in FIG. 5A, in a case of locking the first divided sheet guide plate 82, the hook member 93 locks the locked member 91 attached onto the drive-side sheet guide plate 71 by using biasing force of the tension spring 95 and the safety of the device 70 is thus achieved.

Meanwhile, as shown in FIG. 5B, in a case of unlocking the first divided sheet guide plate 82, the user pushes the unlock lever 94 in a direction opposite to the draw-out direction against the biasing force of the tension spring 95, and causes the hook member 93 to turn clockwise about the shaft 93*a* via the shaft supporting leaf spring member 92A connected to the unlock lever 94. This causes the hook portion 93*b* of the hook member 93 to move away from the locked member 91 attached onto the drive-side sheet guide plate 71 and the first divided sheet guide plate 82 is unlocked. The draw-out operation of the first divided sheet guide plate 82 is thus made possible.

Figures 6A, 6B, 6C:
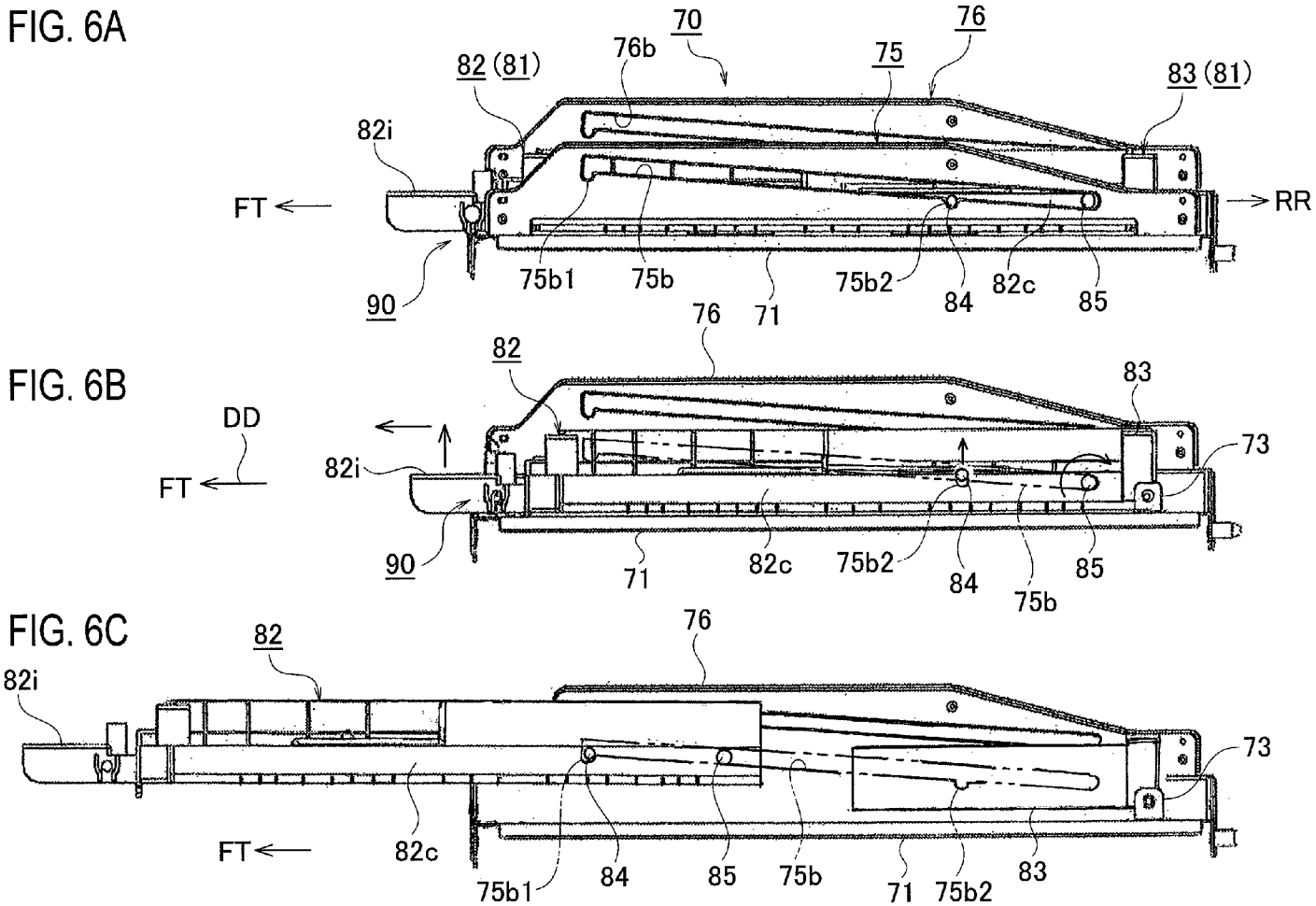
FIG. 6A is a view for explaining operations of the sheet transfer device in Embodiment 0.1 of the present invention, and is a side view of the sheet transfer device in the locked state.
FIG. 6B is a view for explaining the operations of the sheet transfer device in Embodiment 1 of the present invention, and is a side cross-sectional view of the sheet transfer device in a state where draw-out is started.
FIG. 6C is a view for explaining the operations of the sheet transfer device in Embodiment 1 of the present invention, and is a side cross-sectional view of the sheet transfer device in a state where the draw-out is completed.

Next, by using FIGS. 6A to 6C, description is given of operations of the sheet transfer device 70 of Embodiment 1 of the present invention configured as described above.

FIGS. 6A to 6C show the operations of the sheet transfer device 70 of Embodiment 1 of the present invention. FIG. 6A is a side view of the paired draw-out guide plates 75 and 76 as viewed in the sheet transfer direction from the upstream side toward the downstream side. FIGS. 6B and 6C are side cross-sectional views in which the upstream draw-out guide plate 75 is omitted and the inclined guide groove 75*b* of the upstream draw-out guide plate 75 is shown by two-dot chain lines.

Note that, in the following description of the operations of the sheet transfer device 70 of Embodiment 1, only the upstream side surface 82*c* side of the first divided sheet guide plate 82 is described, and description of the downstream side surface 82*d* (FIG. 4) side which is formed symmetric to the upstream side surface 82*c* side at a different height level is omitted.

First, as shown in FIG. 6A, in the sheet transfer device 70 of Embodiment 1, the first divided sheet guide plate 82 of the driven-side sheet guide plate 81 is housed in the front portion of the device 70 while facing the drive-side sheet guide plate 71, and the second divided sheet guide plate 83 of the driven-side sheet guide plate 81 is housed in the rear portion of the device 70 at the same height level as the first divided sheet guide plate 82 not being drawn out yet. In this case, the first and second divided sheet guide plates 82 and 83 maintain a posture substantially parallel to the drive-side sheet guide plate 71, at the same height level, while facing the drive-side sheet guide plate 71.

In this case, the small-diameter pin 84 on the front side in the draw-out direction out of the small-diameter pin 84 and the large-diameter pin 85 fixedly attached to the side surface 82*c* of the first divided sheet guide plate 82 engages with the second positioning recess 75*b*2 on the rear side formed in the inclined guide groove 75*b* of the upstream draw-out guide plate 75, and the large-diameter pin 85 on the rear side in the draw-out direction is positioned at the rear end of the inclined guide groove 75*b*. The first divided sheet guide plate 82 is thus positioned at the housed position.

Moreover, the first divided sheet guide plate 82 is locked to the drive-side sheet guide plate 71 by the lock mechanism 90 provided in the rear portion of the handle 82*i* of the first divided sheet guide plate 82.

Hence, when the first divided sheet guide plate 82 is locked, the sheet P can be transferred (can be made to pass) by the sheet transfer roller pairs R (FIGS. 1, 7A, and 7B) in the sheet transfer device 70 of Embodiment 1.

Next, as shown in FIG. 6B, when sheet jam occurs in the sheet transfer device 70 of Embodiment 1 and the user unlocks the lock mechanism 90 and raises the handle 82*i* of the first divided sheet guide plate 82, the first divided sheet guide plate 82 is turned clockwise about the large-diameter pin 85 fixedly attached to the side surface 82*c*, in the inclined guide groove 75*b* shown by the two-dot chain line.

This causes the small-diameter pin 84 fixedly attached to the side surface 82*c* to move out from the second positioning recess 75*b*2 on the rear side and enter the inclined guide groove 75*b*. The user then starts to draw out the first divided sheet guide plate 82 toward the front side which is the draw-out direction while grabbing the handle 82*i*.

Then, with the draw-out operation of the first divided sheet guide plate 82' toward the front side, the driven rollers R2 (FIGS. 1, 7A, and 7B) in the first divided sheet guide plate 82 move away from the drive rollers R1 (FIGS. 1, 7A, and 7B) in the drive-side sheet guide plate 71 and nipping of the sheet P (FIGS. 1 and 2) is released as will be described later.

Meanwhile, the second divided sheet guide plate 83 turnably supported by the L-shaped bracket 73 attached to the rear end portion of the drive-side sheet guide plate 71 maintains the posture substantially parallel to the drive-side sheet guide plate 71 while maintaining the position.

Next, as shown in FIG. 6C, when the user further draws out the first divided sheet guide plate 82 toward the front side, the small-diameter pin 84 and the large-diameter pin 85 fixedly attached to the side surface 82*c* of the first divided sheet guide plate 82 are guided obliquely upward along the inclined guide groove 75*b* shown by the two-dot chain line.

Thereafter, when the small-diameter pin 84 engages with the first positioning recess 75*b*1 on the front side formed in the inclined guide groove 75*b*, the first divided sheet guide plate 82 is positioned at the maximum draw-out position on the front side.

Moreover, when the small-diameter pin 84 described above engages with the first positioning recess 75*b*1, the front end of the first divided sheet guide plate 82 slightly falls and the first divided sheet guide plate 82 is made to maintain the posture substantially parallel to the drive-side sheet guide plate 71 at a position higher than the second divided sheet guide plate 83. The draw-out of the first divided sheet guide plate 82 is thus completed.

Meanwhile, the second divided sheet guide plate 83 maintains the posture substantially parallel to the drive-side sheet guide plate 71 at the position on the rear side away from the first divided sheet guide plate 82.

Then, even if a jammed sheet (not illustrated) exists across the sheet transfer device and its adjacent sheet transfer device (not illustrated) as will be described later when the first divided sheet guide plate 82 is positioned at the maximum draw-out position on the front side, the user can easily take out the jammed sheet (not illustrated) placed on the drive-side sheet guide plate 71 from the device 70 without leaving any piece of the jammed sheet in the device 70.

Figure 7A:
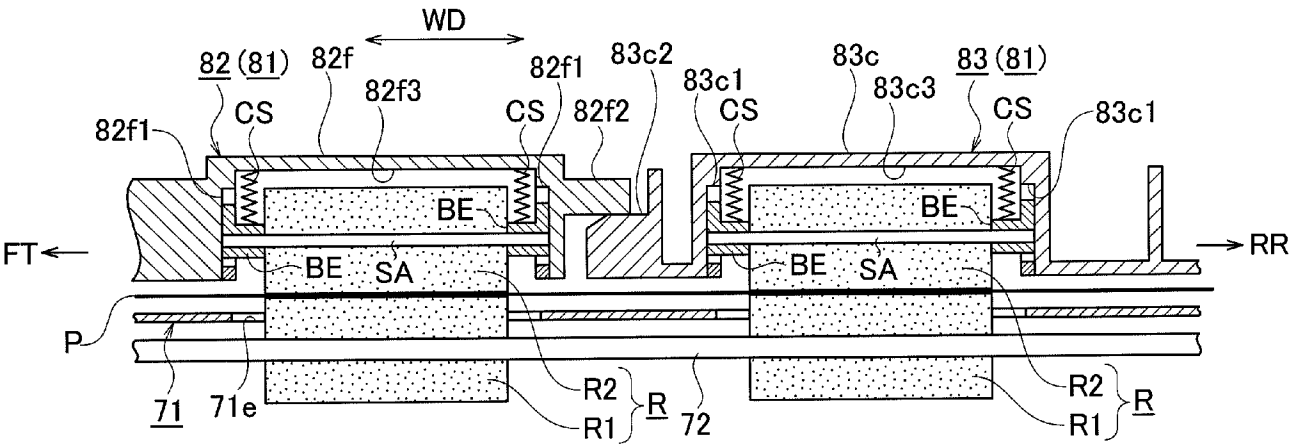
FIG. 7A is a vertical cross-sectional view of the sheet transfer device in Embodiment 1 of the present invention in the locked state which is taken along the VII-VII line of FIG. 2 and which shows a nipping state of drive rollers and driven rollers of sheet transfer roller pairs.
Figure 7B:
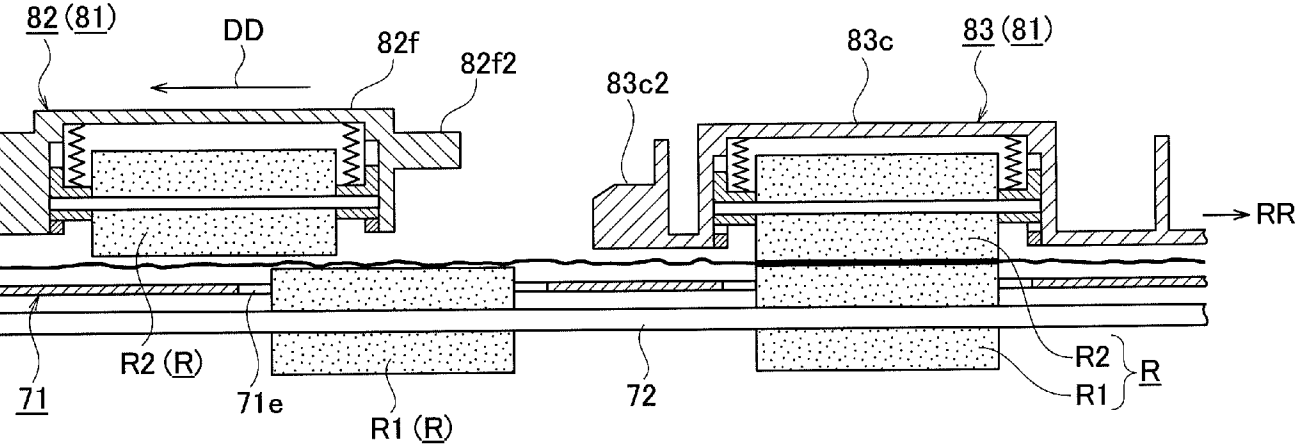
FIG. 7B is a vertical cross-sectional view of the sheet transfer device in Embodiment 1 of the present invention in the drawn-out state which is taken along the VII-VII line of FIG. 2 and which shows the nipping state of the drive rollers and the driven rollers of the sheet transfer roller pairs.

Here, by using FIGS. 7A and 7B, description is given of a nipping state of the drive rollers R1 and the driven rollers R2 of the sheet transfer roller pairs R shown in FIG. 1 in a case of transferring the sheet P in the sheet transfer device 70 of Embodiment 1.

FIGS. 7A and 7B show a nipping state of the drive rollers R1 and the driven rollers R2 of the sheet transfer roller pairs R at a cross section taken along the VII-VII line shown in FIG. 2. FIG. 7A shows a state where the first divided sheet guide plate 82 is locked. FIG. 7B shows a state where the first divided sheet guide plate 82 is drawn out.

As shown in FIG. 7A, the drive rollers R1 of the sheet transfer roller pairs R are fixedly attached to the long first roller shaft 72 formed below the drive-side sheet guide plate 71 and extending in the sheet width direction, and are exposed from the rectangular holes 71*e*.

Meanwhile, the driven rollers R2 of the sheet transfer roller pairs R are fixedly attached to short roller shafts SA formed in the box portions 82*f* and 83*c* and extending in the sheet width direction, and bearings BE are fitted to both ends of each of the second roller shafts SA, the box portion 82*f* and 83*c* formed respectively in the first and second divided sheet guide plates 82 and 83 of the driven-side sheet guide plate 81.

Moreover, bearing supporting bottomed holes 82*f*1 and 83*c*1 are formed on both sides, in the sheet width direction, of the box portions 82*f* and 83*c* formed respectively in the first and second divided sheet guide plates 82 and 83. The bearings BE fitted to both ends of the second roller shafts SA are fitted into the bearing supporting bottomed holes 82*f*1 and 83*c*1 loosely in the vertical direction while being stopped from rotating with upper portions of the bearings BE locked. Moreover, compression springs CS are provided between the bearings BE and interior ceiling surfaces 83*f*3 and 83*c*3 of the box portions 82*f* and 83*c*.

Moreover, a flange 82*f*2 is formed continuously with an outer upper portion of the box portion 82*f* of the first divided sheet guide plate 82 to protrude toward the rear side. Meanwhile, a rib 83*c*2 is formed continuously with an outer lower portion of the box portion 83*c* of the second divided sheet guide plate 83 to protrude toward the front side.

Since the flange 82*f*2 formed in the first divided sheet guide plate 82 is placed on the rib 83*c*2 formed in the second divided sheet guide plate 83 when the first divided sheet guide plate 82 is locked to the drive-side sheet guide plate 71, the front end portion of the second divided sheet guide plate 83 on the front side is held down toward the drive-side sheet guide plate 71.

Due to this, the driven rollers R2 housed in the box portions 82*f* and 83*c* formed respectively in the first and second divided sheet guide plates 82 and 83 can come into pressure contact with the drive rollers R1 with the sheet P interposed therebetween, by biasing force of the compression springs CS in the locked state, and thus transfer the sheet P.

Meanwhile, as shown in FIG. 7B, when the first divided sheet guide plate 82 is unlocked from the drive-side sheet guide plate 71 and is then drawn out toward the front side, the flange 82*f*2 formed continuously with the box portion 82*f* of the first divided sheet guide plate 82 moves away from the rib 83*c*2 formed continuously with the box portion 83*c* of the second divided sheet guide plate 83, with the draw-out operation of the first divided sheet guide plate 82. Accordingly, the second divided sheet guide plate 83 is no longer held down by the first divided sheet guide plate 82.

Due to this, regarding pressing contact force to the drive roller R1 applied by the driven roller R2 housed in the box portion 83*c* of the second divided sheet guide plate 83, although the weight of the driven roller R2 is applied to the drive roller R1, the biasing force of the compression springs CS is reduced. This facilitates take out of the jammed sheet (not illustrated) nipped by the sheet transfer roller pair R in the second divided sheet guide plate 83.

Furthermore, when the first divided sheet guide plate 82 is drawn out toward the front side, the first divided sheet guide plate 82 is moved obliquely upward along the inclined guide grooves 75*b* and 76*b* of the paired draw-out guide plates 75 and 76 (FIG. 3). Accordingly, the driven roller R2 housed in the box portion 82*f* of the first divided sheet guide plate 82 gradually moves away from the drive roller R1 and the nipping between the rollers R1 and R2 is released, and the nipping of a jammed sheet JP placed on the drive-side sheet guide plate 71 is thus released.

Figure 8A:
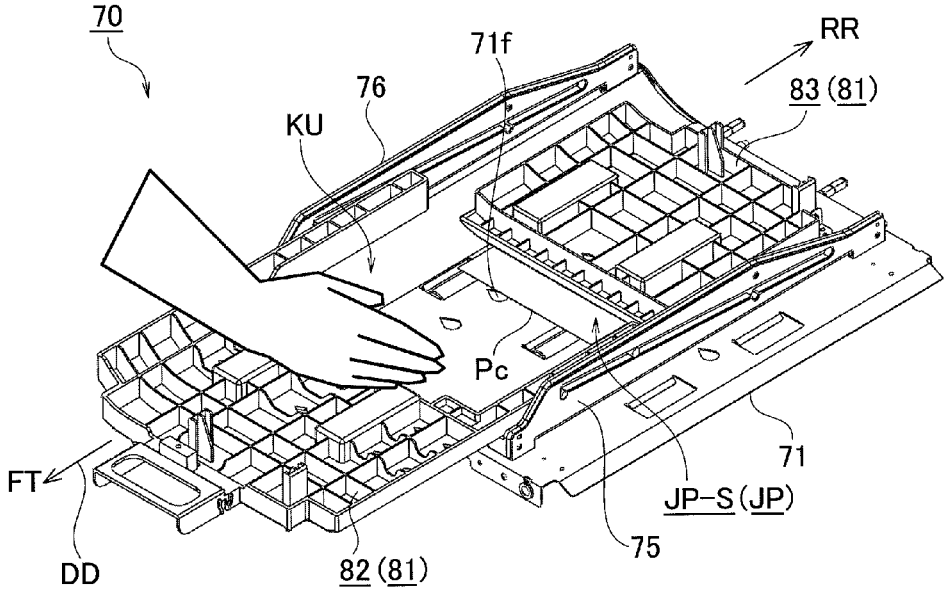
FIG. 8A is a perspective view showing a situation where a jammed sheet of the smallest size is to be taken out from the sheet transfer device in Embodiment 1 of the present invention.
Figure 8B:
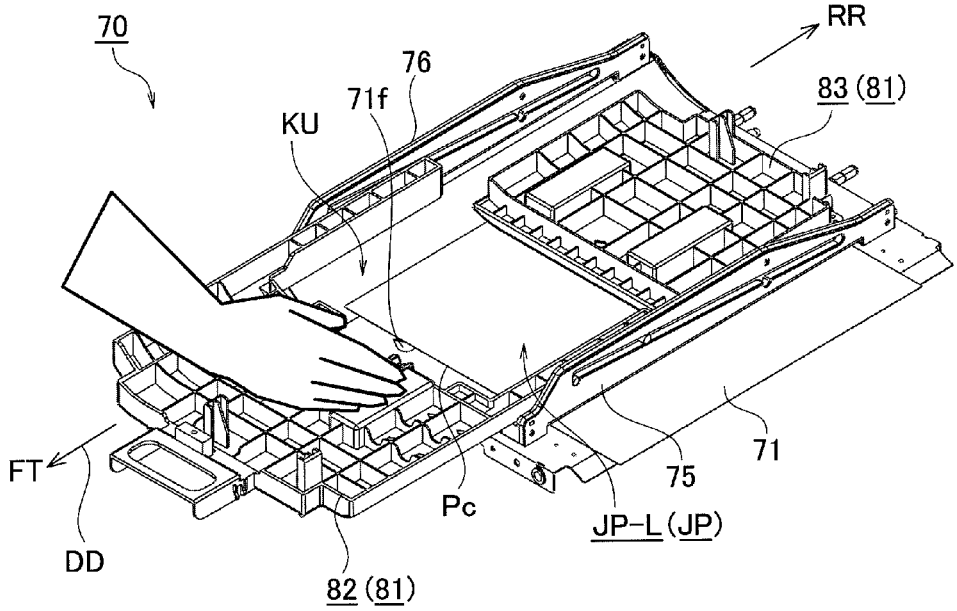
FIG. 8B is a perspective view showing a situation where a jammed sheet of the largest size is to be taken out from the sheet transfer device in Embodiment 1 of the present invention.

Next, by using FIGS. 8A and 8B, description is given of a method of taking out the jammed sheet from an inside of the sheet transfer device 70 of Embodiment 1.

FIGS. 8A and 8B show perspective views of a situation where the jammed sheet JP is taken out from the inside of the sheet transfer device 70 of Embodiment 1. FIG. 8A shows take-out of a jammed sheet JP-S of the smallest size. FIG. 8B shows take-out of a jammed sheet JP-L of the largest size.

As described above, whether sheet jam has occurred or not in the sheet transfer device 70 of Embodiment 1 is detected by the sheet sensors S (FIG. 1) provided at the appropriate positions along the sheet transfer route.

When the controller 60 (FIG. 1) recognizes occurrence of sheet jam, the controller 60 displays an alarm on the operation panel unit 10 (FIG. 1) and, as shown in FIGS. 8A and 8B, the user manually draws out only the first divided sheet guide plate 82 out of the first and second divided sheet guide plates 82 and 83 forming the driven-side sheet guide plate 81, along the paired draw-out guide plates 75 and 76 to the maximum draw-out position.

In this case, in the sheet transfer device 70, the drive-side sheet guide plate 71 and the second divided sheet guide plate 83 maintain their original positions.

Moreover, as shown in FIG. 8B, the maximum draw-out position of the first divided sheet guide plate 82 is set at such a position that a person can grab the left end portion Pc, which is a draw-out side end portion, of the jammed sheet JP-L of the largest size (for example, A3 size) placed on the drive-side sheet guide plate 71 with his/her hand.

Furthermore, the space KU large enough for a person to insert his/her hand is formed above the first divided sheet guide plate 82 drawn out toward the front side of the device 70 as described above. Accordingly, the person inserts his/her hand into the space KU.

Then, as shown in FIG. 8A or 8B, the user holds the left end portion Pc, in the width direction, of the jammed sheet JP-S of the smallest size (for example, postcard size) or the jammed sheet JP-L of the largest size (for example, A3 size), which is the jammed sheet JP placed on the drive-side sheet guide plate 71, with his/her fingers in a portion of the finger hole 71*f* formed in the drive-side sheet guide plate 71 at a position corresponding to the sheet size, and thereby takes out the jammed sheet from the device 70.

At this time, even if the jammed sheet JP exists across the sheet transfer device and its adjacent sheet transfer device (not illustrated), the jammed sheet JP placed on the drive-side sheet guide plate 71 is not drawn out in the draw-out of the first divided sheet guide plate 82. Accordingly, the jammed sheet JP is not torn in the draw-out operation of the first divided sheet guide plate 82.

Moreover, since the first divided sheet guide plate 82 refrains from holding down the second divided sheet guide plate 83 with the draw-out operation of the first divided sheet guide plate 82, a nipping pressure against the sheet P between the drive roller R1 and the driven roller R2 in the second divided sheet guide plate 83 is reduced. This facilitates removal of the jammed sheet JP nipped by the sheet transfer roller pair R on the second divided sheet guide plate 83 side.

Moreover, when the first divided sheet guide plate 82 is drawn out toward the one surface side which is the front side of the device 70, the user can easily take out the jammed sheet JP from the device 70 with his/her hand without leaving any piece of the jammed sheet JP in the device 70.

Furthermore, since the driven-side sheet guide plate 81 is divided into two parts of the first divided sheet guide plate 82 and the second divided sheet guide plate 83, an area occupied by the first divided sheet guide plate 82 in the draw-out can be reduced from that in a conventional device. Moreover, since the weight of the first divided sheet guide plate 82 is smaller than that in the conventional device, load for drawing out the first divided sheet guide plate 82 can be reduced.

Figure 9A:
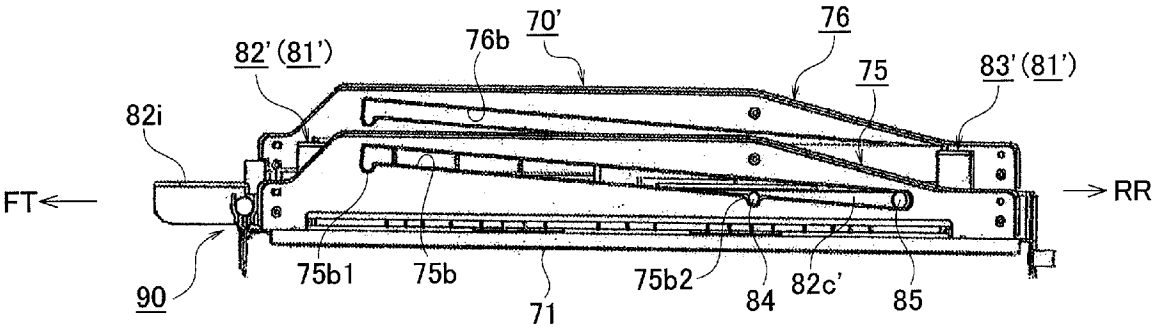
FIG. 9A is a view for explaining operations of a sheet transfer device in a modified example of Embodiment 1, and is a side view of the sheet transfer device in a locked state.
Figure 9B:
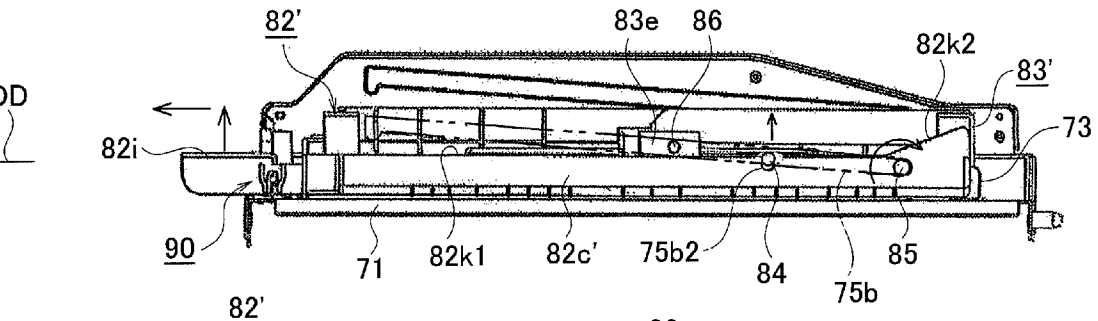
FIG. 9B is a view for explaining the operations of the sheet transfer device in the modified example of Embodiment 1, and is aside cross-sectional view of the sheet transfer device in a state where draw-out is started.
Figure 9C:
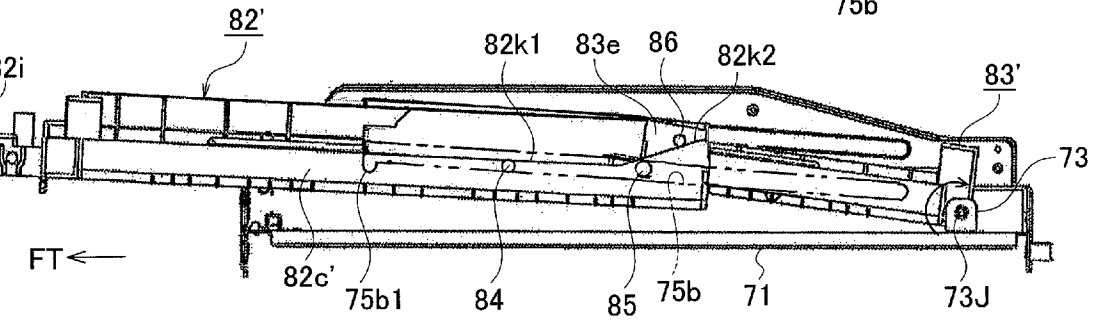
FIG. 9C is a view for explaining the operations of the sheet transfer device in the modified example of Embodiment 1, and is a side cross-sectional view of the sheet transfer device in a state where the draw-out is being performed.

Next, the modified example in which the sheet transfer device 70 of Embodiment 1 is partially modified is described by using FIGS. 9A to 9C.

FIGS. 9A to 9C show a configuration and operations of the sheet transfer device 70' of the modified example partially-modified from Embodiment 1. FIG. 9A is a side view of the paired draw-out guide plates 75 and 76 as viewed in the sheet transfer direction from the upstream side toward the downstream side. FIGS. 9B and 9C are side cross-sectional views in which the upstream draw-out guide plate 75 is omitted and the inclined guide groove 75*b* of the upstream draw-out guide plate 75 is shown by two-dot chain lines.

The sheet transfer device 70' of the modified example partially-modified from Embodiment 1 which is shown in FIGS. 9A to 9C is different from the configuration of the sheet transfer device 70 of Embodiment 1 described above only in first and second divided sheet guide plates 82' and 83' of a driven-side sheet guide plate (driven-roller-side sheet transfer guide plate) 81' facing the drive-side sheet guide plate (drive-roller-side sheet transfer guide plate) 71. Here, the constitutional members described above are denoted by the same reference numerals and described as necessary for convenience of description. Meanwhile, constitutional members different from those in Embodiment 1 are denoted by new reference numerals and described.

Note that, in the following description of the configuration and operations of the sheet transfer device 70' of the modified example of Embodiment 1, only an upstream side surface 82*c'* side of the first divided sheet guide plate 82' is described, and description of a downstream side surface 82*d'* (not illustrated) side which is formed symmetric to the upstream side surface 82*c'* side at a different height level is omitted.

The sheet transfer device 70' of the modified example of Embodiment 1 shown in FIG. 9A is also provided along the sheet transfer route in the inkjet printer 1 (FIG. 1). For example the sheet transfer device 70' is unitized and provided along the horizontal transfer route JR2 in the circulation transfer route JR forming part of the sheet transfer route.

The configuration of the sheet transfer device 70' of the modified example of Embodiment 1 is described. As shown in FIGS. 9B and 9C, the first divided sheet guide plate 82' of the driven-side sheet guide plate 81' is formed such that, unlike Embodiment 1, an upper portion of the upstream side surface 82*c'* in the sheet transfer direction is formed to have a flat surface 82*k*1 which extends from the front side toward the rear side at a low height level. Moreover, a substantially-triangular inclined cam surface 82*k*2 which is continuous with the flat surface 82*k*1 and which is gradually inclined upward is formed in a rear end portion of the upstream side surface 82*c'*.

Meanwhile, in the second divided sheet guide plate 83' of the driven-side sheet guide plate 81', a pin 86 is laterally provided on the upstream side surface 83*e* to extend outward, unlike Embodiment 1.

Here, description is given of the operations of the sheet transfer device 70' of the modified example of Embodiment 1 configured as described above.

First, as shown in FIG. 9A, in the sheet transfer device 70' of the modified example of Embodiment 1, the first divided sheet guide plate 82' of the driven-side sheet guide plate 81' is housed in a front portion of the sheet transfer device 70' to face the drive-side sheet guide plate 71 and the second divided sheet guide plate 83' of the driven-side sheet guide plate 81' is housed in a rear portion of the sheet transfer device 70' at the same height position as the first divided sheet guide plate 82' not being drawn out yet, as in Embodiment 1.

In this case, the small-diameter pin 84 on the front side in the draw-out direction out of the small-diameter pin 84 and the large-diameter pin 85 fixedly attached to the side surface 82*c'* of the first divided sheet guide plate 82' engages with the second positioning recess 75*b*2 on the rear side formed in the inclined guide groove 75*b* of the upstream draw-out guide plate 75, and the large-diameter pin 85 on the rear side in the draw-out direction is positioned at the rear end of the inclined guide groove 75*b*. The first divided sheet guide plate 82' is thus positioned at the housed position.

Moreover, the first divided sheet guide plate 82' is locked to the drive-side sheet guide plate 71 by the lock mechanism 90 provided in the rear portion of the handle 82*i* of the first divided sheet guide plate 82'.

Hence, when the first divided sheet guide plate 82' is locked, the sheet P can be transferred (can be made to pass) by the sheet transfer roller pairs R (FIGS. 1, 7A, and 7B) in the sheet transfer device 70' of the modified example of Embodiment 1.

Next, as shown in FIG. 9B, when sheet jam occurs in the sheet transfer device 70' of the modified example of Embodiment 1 and the user unlocks the lock mechanism 90 and raises the handle 82*i* of the first divided sheet guide plate 82', the first divided sheet guide plate 82' is turned clockwise about the large-diameter pin 85 fixedly attached to the side surface 82*c'*, in the inclined guide groove 75*b* shown by the two-dot chain line.

This causes the small-diameter pin 84 fixedly attached to the side surface 82*c'* to move out from the second positioning recess 75*b*2 on the rear side. The user then starts to draw out the first divided sheet guide plate 82' toward the front side which is the draw-out direction while grabbing the handle 82*i*.

Then, with the draw-out operation of the first divided sheet guide plate 82' toward the front side, the driven rollers R2 (FIGS. 1, 7A, and 7B) in the first divided sheet guide plate 82' move away from the drive rollers R1 (FIGS. 1, 7A, and 7B) in the drive-side sheet guide plate 71 and nipping of the sheet P (FIGS. 1 and 2) is released.

At this time, since the pin 86 fixedly attached to the upstream side surface 83*e* of the second divided sheet guide plate 83' slides along the flat surface 82*k*1 formed in the upper portion of the upstream side surface 82*c'* of the first divided sheet guide plate 82', the second divided sheet guide plate 83' turnably supported by the L-shaped bracket 73 attached to a rear end portion of the drive-side sheet guide plate 71 maintains the posture substantially parallel to the drive-side sheet guide plate 71 while maintaining the position.

Next, as shown in FIG. 9C, when the user further draws out the first divided sheet guide plate 82' toward the front side, the pin 86 fixedly attached to the upstream side surface 83*e* of the second divided sheet guide plate 83' slides over from the flat surface 82*k*1 to the inclined cam surface 82*k*2 which are formed in the upper portion of the upstream side surface 82*c*' of the first divided sheet guide plate 82', with the further draw-out operation of the first divided sheet guide plate 82'. The second divided sheet guide plate 83' thus turns clockwise about a shaft 73J rotatably supported by the L-shaped bracket 73.

This causes the driven rollers R2 housed in the box portions 83*c* (FIG. 4) of the second divided sheet guide plate 83' to move away from the drive rollers R1 and nipping of the sheet P (FIGS. 1 and 2) is thereby released.

In this case, the inclined cam surface 82*k*2 formed in the rear end portion of the upstream side surface 82*c*' of the first divided sheet guide plate 82' is formed to have a short movement length in the draw-out direction of the first divided sheet guide plate 82' and does not extend to a position where the pin 86 is located when the first divided sheet guide plate 82' is in the maximum draw-out position. In such a configuration, it is only necessary to temporarily latch the second divided sheet guide plate 83' at a maximum turning position by using a not-illustrated latch portion when the pin 86 reaches a terminal end of the inclined cam surface 82*k*2.

Then, as in Embodiment 1, even if a jammed sheet (not illustrated) exists across the sheet transfer device and its adjacent sheet transfer device (not illustrated) when the first divided sheet guide plate 82' is positioned at the maximum draw-out position on the front side, the user can easily take out the jammed sheet (not illustrated) placed on the drive-side sheet guide plate 71 from the device 70' without leaving any piece of the jammed sheet in the device 70'.

Note that, in the case returning the first divided sheet guide plate 82' to the housed position, it is only necessary to release the latch of the not-illustrate latch portion with the housing operation of the first divided sheet guide plate 82'.

In the sheet transfer device 70' of the modified example of Embodiment 1, the nipping of the drive rollers R1 and the driven rollers R2 housed in the box portions 82*c* (FIG. 4) of the second divided sheet guide plate 83' is released with the draw-out operation of the first divided sheet guide plate 82'. Accordingly, the jammed sheet released from nipping on both of the first and second divided sheet guide plate 82' and 83' sides can be more easily taken out.

Embodiment 2

Figure 10A:
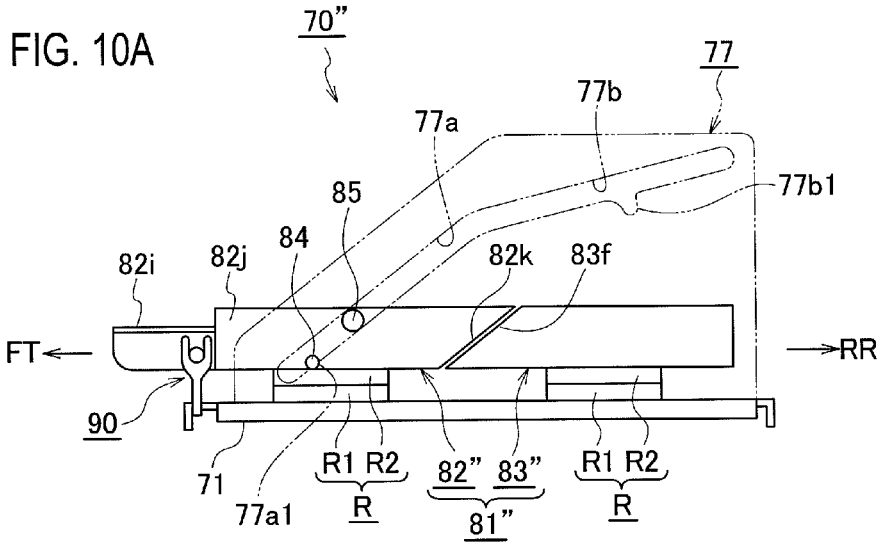
FIG. 10A is a view for explaining a configuration and operations of a sheet transfer device in Embodiment 2 of the present invention in a locked state.
Figure 10B:
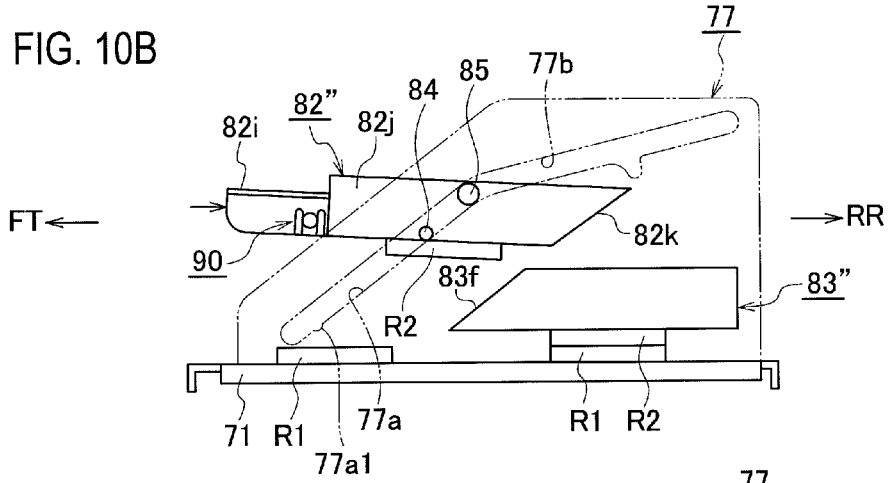
FIG. 10B is a view for explaining a configuration and operations of the sheet transfer device in Embodiment 2 of the present invention in a state where push-in is being performed.
Figure 10C:
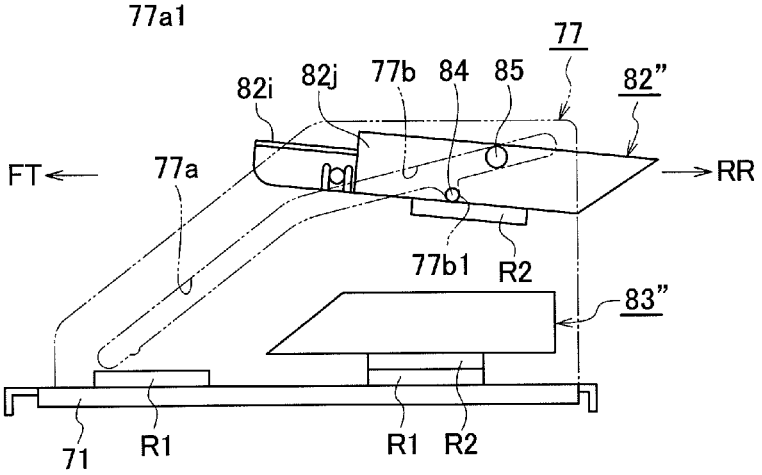
FIG. 10C is a view for explaining a configuration and operations of the sheet transfer device in Embodiment 2 of the present invention in a state where the push-in is completed.

FIGS. 10A to 10C show a configuration and operations of the sheet transfer device 70" of Embodiment 2 of the present invention. FIG. 10A shows a state where a first divided sheet guide plate 82" is locked. FIG. 10B shows a state where the first divided sheet guide plate 82" is being pushed in. FIG. 100 shows a state where push-in of the first divided sheet guide plate 82" is completed. Note that only the right surface side of the sheet transfer device 70" of Embodiment 2 is illustrated in FIGS. 10A to 10C.

The sheet transfer device 70" of Embodiment 2 of the present invention shown in FIGS. 10A to 100 is the same as the aforementioned sheet transfer device 70 (FIG. 2) of Embodiment 1 and the aforementioned sheet transfer device 70' (FIGS. 9A to 9C) in the modified example partially-modified from Embodiment 1 in that a driven-side sheet guide plate (driven-roller-side sheet transfer guide plate) 81" supporting the driven rollers R2 and facing the drive-side sheet guide plate (drive-roller-side sheet transfer guide plate) 71 supporting the drive rollers R1 is divided into two parts of first and second divided sheet guide plates 82" and 83".

In Embodiment 1 and the modified example partially-modified from Embodiment 1, the first divided sheet guide plates 82 and 82' of the driven-side sheet guide plates 81 and 81' are configured to be capable of being drawn out toward the front side in the case of removing the jammed sheet JP (FIGS. 8A and 8B). However, the sheet transfer device 70" of Embodiment 2 is different from this in that the first divided sheet guide plate 82" of the driven-side sheet guide plate 81" is configured to be capable of being pushed in toward a rear upper side of the sheet transfer device 70".

Here, the constitutional members described above are denoted by the same reference numerals and described as necessary for convenience of description. Meanwhile, constitutional members different from those in Embodiment 1 and the modified example of Embodiment 1 are denoted by new reference numerals and described.

The sheet transfer device 70" of Embodiment 2 shown in FIG. 10A is also provided along the sheet transfer route in the inkjet printer 1 (FIG. 1). For example, the sheet transfer device 70" is unitized and provided along the horizontal transfer route JR2 in the circulation transfer route JR forming part of the sheet transfer route.

First, the configuration of the sheet transfer device 70" of Embodiment 2 is described.

Paired push-In guide plates 77 (and 78, not illustrated) are attached to an upstream portion (right portion) and a downstream portion (left portion) of the drive-side sheet guide plate 71 in the transfer direction of the sheet P (FIG. 1) which is a direction perpendicular to the sheet surface of the drawing. Hereafter, illustration of the downstream portion (left portion) which is symmetric to the upstream portion (right portion) is omitted.

Moreover, first and second inclined guide grooves 77*a* and 77*b* are formed in the upstream (right) push-in guide plate 77 shown by two-dot chain lines to be inclined upward from the front side toward the rear side. The first divided sheet guide plate 82" of the driven-side sheet guide plate 81" is guided along the first and second inclined guide grooves 77*a* and 77*b* to be capable of being pushed in from the front side toward the rear upper side.

Here, the first inclined guide groove 77*a* formed on the front side is formed to have a steep inclination. Meanwhile, the second inclined guide groove 77*b* formed on the rear side continuously with the first inclined guide groove 77*a* is formed to have an inclination shallower than the first inclined guide groove 77*a*.

Furthermore, a first positioning recess 77*a*1 used to position the first divided sheet guide plate 82" on the front side is formed in the first inclined guide groove 77*a* in a shape recessed downward. Meanwhile, a second positioning recess 77*b*1 used to position the first divided sheet guide plate 82" on the rear side is formed in the second inclined guide groove 77*b* in a shape recessed downward.

Next, the handle 82*i* is formed in the first divided sheet guide plate 82" out of the first and second divided sheet guide plates 82" and 83" of the driven-side sheet guide plate 81' to protrude toward the front side.

Moreover, the small-diameter pin 84 and the large-diameter pin 85 are attached to a side surface 82*j* of the first divided sheet guide plate 82" at an interval in the front-rear direction. The small-diameter pin 84 and the large-diameter pin 85 are fitted into the first and second inclined guide groove 77*a* and 77*b* formed in the right push-in guide plate 77.

Moreover, a first inclined cam 82*k* is formed in a rear end portion of the first divided sheet guide plate 82" of the driven-side sheet guide plate 81" on the rear side to be inclined upward from the front side toward the rear side.

Meanwhile, a second inclined cam 83*f* is formed in a front end portion of the second divided sheet guide plate 83" of the driven-side sheet guide plate 81" on the front side to be inclined downward from the rear side toward front side.

When the driven rollers R2 in the first and second divided sheet guide plates 82" and 83" press the drive rollers R1 in the drive-side sheet guide plate 71, the first inclined cam 82*k* of the first divided sheet guide plate 82" and the second inclined cam 83*f* of the second divided sheet guide plate 83" are in contact with each other. The first inclined cam 82*k* and the second inclined cam 83*f* prevent a case where, when the first divided sheet guide plate 82" is to be pushed in toward the rear side as will be described later, the push-in is made impossible due to collision of the first divided sheet guide plate 82" with the second divided sheet guide plate 83".

Note that, in FIG. 10, reference numeral 90 denotes a lock mechanism configured similarly as that in Embodiment 1.

Description is given of the operations of the sheet transfer device 70" of Embodiment 2 configured as described above.

First, as shown in FIG. 10A, in the sheet transfer device 70" of Embodiment 2, the first divided sheet guide plate 82" of the driven-side sheet guide plate 81" is housed in a front portion of the sheet transfer device 70" to face the drive-side sheet guide plate 71 and the second divided sheet guide plate 83" of the driven-side sheet guide plate 81" is housed in the rear portion of the sheet transfer device 70" at the Same height position as the first divided sheet guide plate 82" not being pushed in yet, as in Embodiment 1 and the modified example of Embodiment 1.

In this case, the small-diameter 84 on the front side out of the small-diameter pin 84 and the large-diameter pin 85 fixedly attached to the side surface 82*j* of the first divided sheet guide plate 82" engages with the first positioning recess 77*a*1 formed in the first inclined guide groove 77*a* of the push-in guide plate 77, and the first divided sheet guide plate 82" is thus positioned at the housed position.

Moreover, the first divided sheet guide plate 82" is locked to the drive-side sheet guide plate 71 by the lock mechanism 90 provided in the rear portion of the handle 82*i* of the first divided sheet guide plate 82".

Hence, when the first divided sheet guide plate 82" is locked, the sheet P can be transferred (can be made to pass) by the sheet transfer roller pairs R (FIGS. 1, 7A, and 7B), which are pairs of drive rollers R1 and driven rollers R2, in the sheet transfer device 70" of Embodiment 2.

Next, as shown in FIG. 10B, when sheet jam occurs in the sheet transfer device 70" of Embodiment 2 and the user unlocks the lock mechanism 90 and pushes the handle 82*i* of the first divided sheet guide plate 82" toward the rear side, the small-diameter pin 84 fixedly attached to the side surface 82*j* of the first divided sheet guide plate 82" is moved out from the first positioning recess 77*a*1 formed in the first inclined guide groove 77*a* of the push-in guide plate 77. Thereafter, the small-diameter pin 84 and the large-diameter pin 85 fixedly attached to the side surface 82*j* of the first divided sheet guide plate 82" are moved upward along the first inclined guide groove 77*a* of the push-in guide plate 77.

At the same time, the first inclined cam 82*k* of the first divided sheet guide plate 82" is moved upward along the second inclined cam 83*f* of the second divided sheet guide plate 83" and is moved away from the second inclined cam 83*f*. In this case, the first divided sheet guide plate 82" moves upward toward the rear without colliding with the second divided sheet guide plate 83".

Then, with the push-in operation of the first divided sheet guide plate 82" toward the rear side, the driven rollers R2 in the first divided sheet guide plate 82" move away from the drive rollers R1 in the drive-side sheet guide plate 71 and nipping of the sheet P (FIG. 1) is released.

Meanwhile, the second divided sheet guide plate 83" maintains a posture substantially parallel to the drive-side sheet guide plate 71 while maintaining the position.

Next, as shown in FIG. 100, when the user further pushes in the first divided sheet guide plate 82" toward the rear side, the small-diameter pin 84 and the large-diameter pin 85 fixedly attached to the side surface 82*j* of the first divided sheet guide plate 82" moves from the first inclined guide groove 77*a* of the push-in guide plate 77 into the second inclined guide groove 77*b*, with the further pushing operation of the first divided sheet guide plate 82".

Thereafter, the small-diameter pin 84 fixedly attached to the side surface 82*j* of the first divided sheet guide plate 82" engages with the second positioning recess 77*b*1 formed in the second inclined guide groove 77*b* of the push-in guide plate 77. The first divided sheet guide plate 82" is thus positioned above the second divided sheet guide plate 83" and the push-in operation is completed.

Then, even if a jammed sheet (not illustrated) exists across the sheet transfer device and its adjacent sheet transfer device (not illustrated) when the first divided sheet guide plate 82" is pushed in and positioned on the rear upper side, the user can easily take out the jammed sheet (not illustrated) placed on the drive-side sheet guide plate 71 from the device 70" without leaving any piece of the jammed sheet in the device 70".

In the sheet transfer device 70" of Embodiment 2, since the first divided sheet guide plate 82" is pushed in toward the rear upper side in the device 70" when the jammed sheet (not illustrated) is to be removed. Since there is no member protruding toward the front side of the device 70", the front side of the device 70" can be effectively used. However, in Embodiment 2, the height of the device 70" needs to be increased by an amount corresponding to the height level at which the first divided sheet guide plate 82" is located above the second divided sheet guide plate 83" when the first divided sheet guide plate 82" is pushed in toward the rear upper side.

Although omitted in the drawings, Embodiment 2 may also be configured such that the nipping of the sheet by the sheet transfer roller pairs in the second divided sheet guide plate is released with the push-in operation of the first divided sheet guide plate.

In the sheet transfer device 70 of Embodiment 1, the sheet transfer device 70' of the modified example partially-modified from Embodiment 1, or the sheet transfer device 70" of Embodiment 2 which are described above in detail, description is given of an example in which the driven-side sheet guide plate 81, 81', or 81" is divided into two parts. However, the present invention is not limited to this configuration and the drive-side sheet guide plate 71 may be divided into two parts. Any configuration can be employed as long as one of the paired sheet transfer guides provided along the sheet transfer route to face each other is divided into two parts.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet transfer device comprising:

a sheet transfer unit including a plurality of paired sheet transfer rollers arranged along a sheet transfer route, and configured to transfer a sheet in a sheet transfer direction while nipping the sheet between each of the plurality of paired sheet transfer rollers; and first and second sheet transfer guide plates arranged along the sheet transfer route to face each other and configured to guide the sheet transferred by the sheet transfer unit, wherein the first sheet transfer guide plate includes a first divided sheet guide plate and a second divided sheet guide plate separably connected to each other at a dividing line extending along the sheet transfer direction, the first divided sheet guide plate is configured to be either drawn out or pushed in relative to the second sheet transfer guide plate in a sheet width direction orthogonal to the sheet transfer direction, the first divided sheet guide plate and the second divided sheet guide plate are separable from each other by one of a draw-out operation or a push-in operation of the first divided sheet guide plate, and the first divided sheet guide plate is configured to release nipping of the sheet by the paired sheet transfer rollers corresponding to the first divided sheet guide plate, during one of the draw-out operation or the push-in operation of the first divided sheet guide plate.

2. The sheet transfer device according to claim 1, wherein the first sheet transfer guide plate is configured to release nipping of the sheet by the paired sheet transfer rollers corresponding to the second divided sheet guide plate, during one of the draw-out operation or the push-in operation of the first divided sheet guide plate.

3. The sheet transfer device according to claim 1, wherein a separation position of the first divided sheet guide plate and the second divided sheet guide plate is one of located between an end portion of a smallest sheet in a draw-out direction of the first divided sheet guide plate and a center line of the smallest sheet in a width direction of the smallest sheet, or located on the center line of the smallest sheet in the width direction, the smallest sheet being a sheet of a smallest size among sheets of differing sizes to be transferred along the sheet transfer route.

4. A sheet transfer device comprising:

a sheet transfer unit including a plurality of paired sheet transfer rollers arranged along a sheet transfer route, and configured to transfer a sheet in a sheet transfer direction while nipping the sheet between each of the plurality of paired sheet transfer rollers; and first and second sheet transfer guide plates arranged along the sheet transfer route to face each other and configured to guide the sheet transferred by the sheet transfer unit, wherein the first sheet transfer guide plate includes a first divided sheet guide plate and a second divided sheet guide plate separably connected to each other, the first divided sheet guide plate is configured to be either drawn out or pushed in relative to the second sheet transfer guide plate in a sheet width direction orthogonal to the sheet transfer direction, the first divided sheet guide plate and the second divided sheet guide plate are separable from each other by one of a draw-out operation or a push-in operation of the first divided sheet guide plate, and the first divided sheet guide plate is configured to release nipping of the sheet by the paired sheet transfer rollers corresponding to the first divided sheet guide plate, during one of the draw-out operation or the push-in operation of the first divided sheet guide plate, wherein the first divided sheet guide plate includes a flange and the second divided sheet guide plate includes a rib, and the flange and the rib are separably connected to each other between the first and second divided sheet guide plates, and when the first divided sheet guide plate is drawn out the flange is separated from the rib, and when the first divided sheet guide plate is pushed in the flange and the rib are connected.

5. The sheet transfer device according to claim 4, wherein the first sheet transfer guide plate is configured to release nipping of the sheet by the paired sheet transfer rollers corresponding to the second divided sheet guide plate, during one of the draw-out operation or the push-in operation of the first divided sheet guide plate.

6. The sheet transfer device according to claim 4, wherein a separation position of the first divided sheet guide plate and the second divided sheet guide plate is one of located between an end portion of a smallest sheet in a draw-out direction of the first divided sheet guide plate and a center line of the smallest sheet in a width direction of the smallest sheet, or located on the center line of the smallest sheet in the width direction, the smallest sheet being a sheet of a smallest size among sheets of differing sizes to be transferred along the sheet transfer route.

* * * * *